US009745781B2

(12) United States Patent
McGinnis et al.

(10) Patent No.: US 9,745,781 B2
(45) Date of Patent: Aug. 29, 2017

(54) REPLACEMENT SHACKLE FOR PORTABLE LOCK

(71) Applicants: Glenn McGinnis, Land O Lakes, FL (US); John Coyne, Mechanicsburg, PA (US); Scott McGinnis, Alpharetta, GA (US)

(72) Inventors: Glenn McGinnis, Land O Lakes, FL (US); John Coyne, Mechanicsburg, PA (US); Scott McGinnis, Alpharetta, GA (US)

(73) Assignee: My Touch ID, LLC, Land O Lakes, FL (US)

( * ) Notice: Subject to any disclaimer, the term of this patent is extended or adjusted under 35 U.S.C. 154(b) by 0 days.

(21) Appl. No.: 15/338,404

(22) Filed: Oct. 30, 2016

(65) Prior Publication Data

US 2017/0044801 A1 Feb. 16, 2017

Related U.S. Application Data

(63) Continuation of application No. 15/134,282, filed on Apr. 20, 2016, now Pat. No. 9,574,377.

(60) Provisional application No. 62/152,502, filed on Apr. 24, 2015.

(51) Int. Cl.

| | |
|---|---|
| ***E05B 67/06*** | (2006.01) |
| ***E05B 63/00*** | (2006.01) |
| ***E05B 67/00*** | (2006.01) |
| ***E05B 67/22*** | (2006.01) |
| ***E05B 67/26*** | (2006.01) |

(52) U.S. Cl.

CPC ..... *E05B 67/063* (2013.01); *E05B 63/0056* (2013.01); *E05B 67/003* (2013.01); *E05B 67/06* (2013.01); *E05B 67/22* (2013.01); *E05B 67/26* (2013.01)

(58) Field of Classification Search

CPC .. E05B 63/0056; E05B 67/003; E05B 37/025; E05B 67/06; E05B 37/10; E05B 67/22; E05B 67/00; E05B 67/26; E05B 67/063; Y10T 70/424; Y10T 70/441; Y10T 70/459; Y10T 70/491

USPC ..... 70/53

See application file for complete search history.

(56) References Cited

U.S. PATENT DOCUMENTS 2,094,604 A * 10/1937 Keil ..... E05B 67/24 70/370
2,133,528 A * 10/1938 Bell ..... E05B 37/10 70/25
2,508,302 A * 5/1950 Stue ..... E05B 67/003 70/19
2,691,288 A * 10/1954 Childs ..... E05B 67/24 70/370
4,241,594 A * 12/1980 Miller ..... E05B 67/24 70/369
4,660,394 A * 4/1987 Wu ..... B60R 25/0221 70/238

(Continued)

*Primary Examiner* — Suzanne Barrett

(74) *Attorney, Agent, or Firm* — Chris Tanner, Esq.; TannerPatent.com

(57) ABSTRACT

A group of embodiments for enabling the replacement of damaged shackles for multiple types of portable locks is disclosed. The embodiments have the ability to alter the shackle size and configuration for multiple types of portable locks by substituting one type of shackle with a different shackle, with no tools or special skills required.

16 Claims, 28 Drawing Sheets

(56) References Cited

U.S. PATENT DOCUMENTS

| | | | | |
|---|---|---|---|---|
| 4,866,958 | A * | 9/1989 | Bretl | E05B 37/163 70/25 |
| 6,029,481 | A * | 2/2000 | Lai | E05B 37/025 70/25 |
| 2008/0250825 | A1* | 10/2008 | Lai | E05B 35/105 70/25 |
| 2008/0289381 | A1* | 11/2008 | Cheevers | E05B 11/00 70/38 A |
| 2009/0301145 | A1* | 12/2009 | Valerio | E05B 35/105 70/21 |
| 2013/0118215 | A1* | 5/2013 | Lai | E05B 37/0034 70/21 |
| 2014/0373579 | A1* | 12/2014 | Lai | E05B 67/06 70/21 |

* cited by examiner

Section AA

FIG. 6A
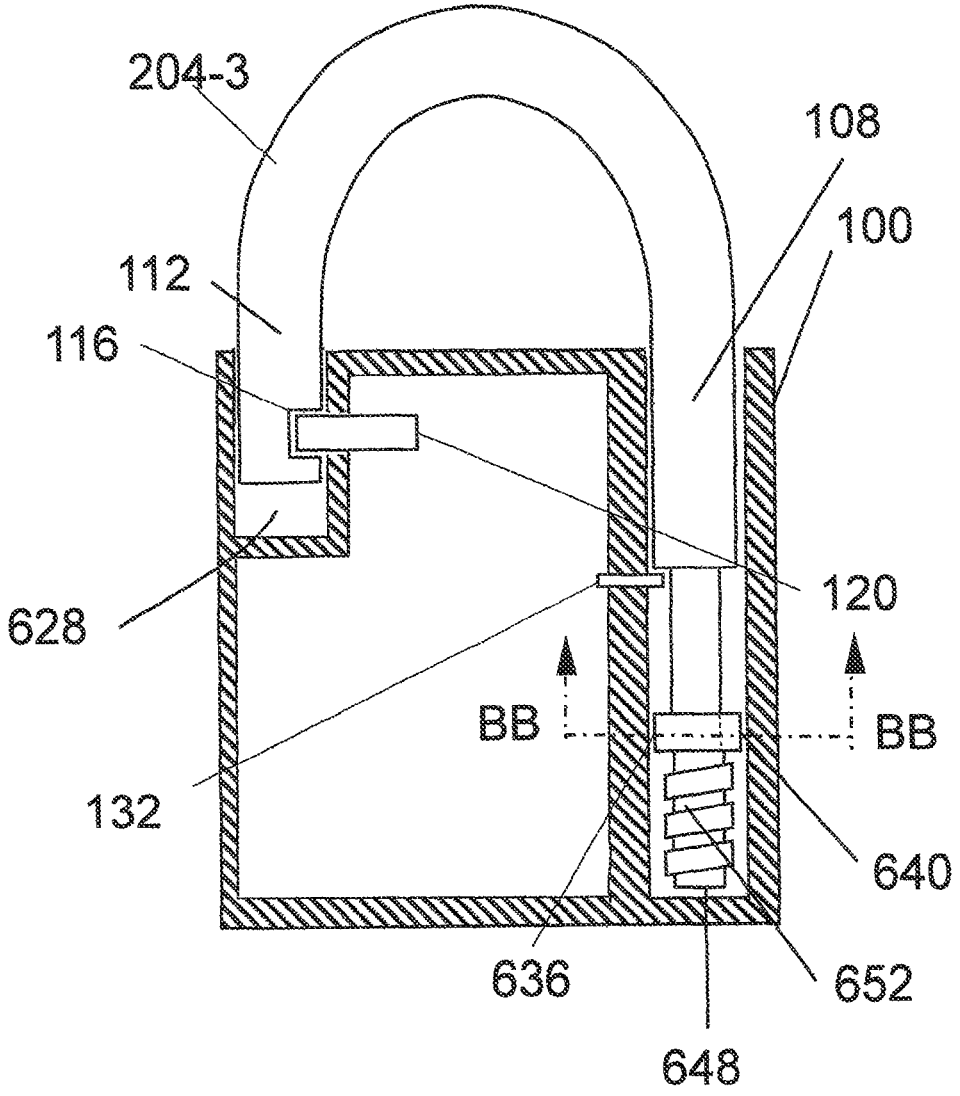
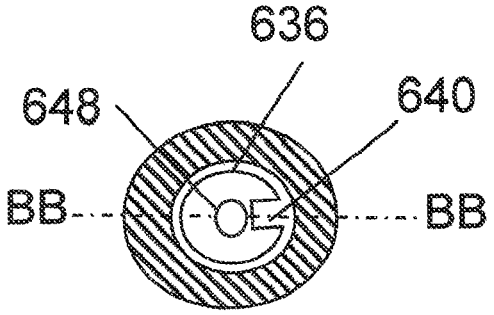
FIG. 6B

View CC-CC

REPLACEMENT SHACKLE FOR PORTABLE LOCK

FIELD OF THE INVENTION

This invention provides a set of solutions to enable the replacement of damaged shackles for multiple types of portable locks (including but not limited to padlocks) and the ability to alter the shackle size and configuration for multiple types of portable locks by substituting one type of shackle with a different shackle, where no tools or special skills are required.

BACKGROUND OF THE INVENTION

When using portable locks, cable locks and other types of portable locks, it is sometimes necessary to break or cut the shackle in order to remove the lock. A very common example of this scenario occurs frequently when a portable lock is used as a Lock Out Tag Out device as required by OSHA regulation 1910.147 to prevent inadvertent or deliberate release of energy from a system undergoing maintenance or inspection. Specifically, OSHA regulation 1910.147 states that there be a "one employee, one key and one lock relationship'. If a project or repair is completed, an employee who placed a personal Lock Out Tag Out portable lock to protect personnel performing this project must be present to remove the portable lock when it is no longer required. If the owner of the lock and its unique key is not present, the lock must be cut off in order to restore the repaired system to an operable state. The damaged lock is then either sent back to the manufacturer for repair, or scrapped.

The proper selection of a portable lock depends upon matching several characteristics, such as shackle specifications including but not limited to shackle material, rigid shackle versus flexible cable shackle, shackle clearance and shackle diameter. If a purchaser desired to purchase a portable lock for multiple purposes that have different shackle requirements, they must purchase a separate lock for each specification. If high reliability and availability of a particular lock shackle type is required, it would be necessary to purchase a backup lock/s of any required configuration.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY OF THE INVENTION

The embodiments disclosed herein describe an invention that eliminates the necessity to return a portable lock with a cut off shackle to the manufacturer for repair or to scrap the lock and purchase a replacement. The resultant decreased replacement rate would also reduce the amount of key changing and duplication when multiple keys are required.

Today's infusion of technology including but not limited to: Biometrics, Radio Frequency Identification (RFID), BlueTooth®. Wi-Fi, encryption, key pads, microelectronics, batch data entry and extraction, event monitoring and recording, enhanced severe climate tolerance and more results in increased dependency and reliance on the humble standalone portable lock that has been a key part of security and safety for over two centuries or more. The increased reliance on technology presents increased functionality that is almost unlimited in scope. There is a price to pay however, technology is not free. The old concept of cut the lock off and purchase a replacement is no longer an acceptable solution. This invention will increase the useful footprint of a higher cost technology centric lock body and increase the useful lifespan of said lock body by easily restoring the unit to service after a cutoff.

The attributes described herein may be independently implemented in the described portable lock. A cost vs security trade off can be made to determine applicability of each of the described features for a specific usage scenario.

DESCRIPTION OF THE DRAWINGS

The present invention is illustrated by way of example, and not by way of limitation, in the figures of the accompanying drawings and in which like reference numerals refer to similar elements and in which: approaches described in this section are approaches that could be pursued, but not limited to such. Therefore, unless otherwise indicated, it should not be assumed that any of the approaches described in this section qualify as prior art merely by virtue of their inclusion in this section.

FIG. 6A is a cross sectional view of another variant of the first embodiment.

FIG. 6B is a cross-sectional view of the lock of FIG. 6A, taken along the line BB-BB.

DETAILED DESCRIPTION OF THE PREFERRED EMBODIMENTS

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present inventions.

Figure 1A:
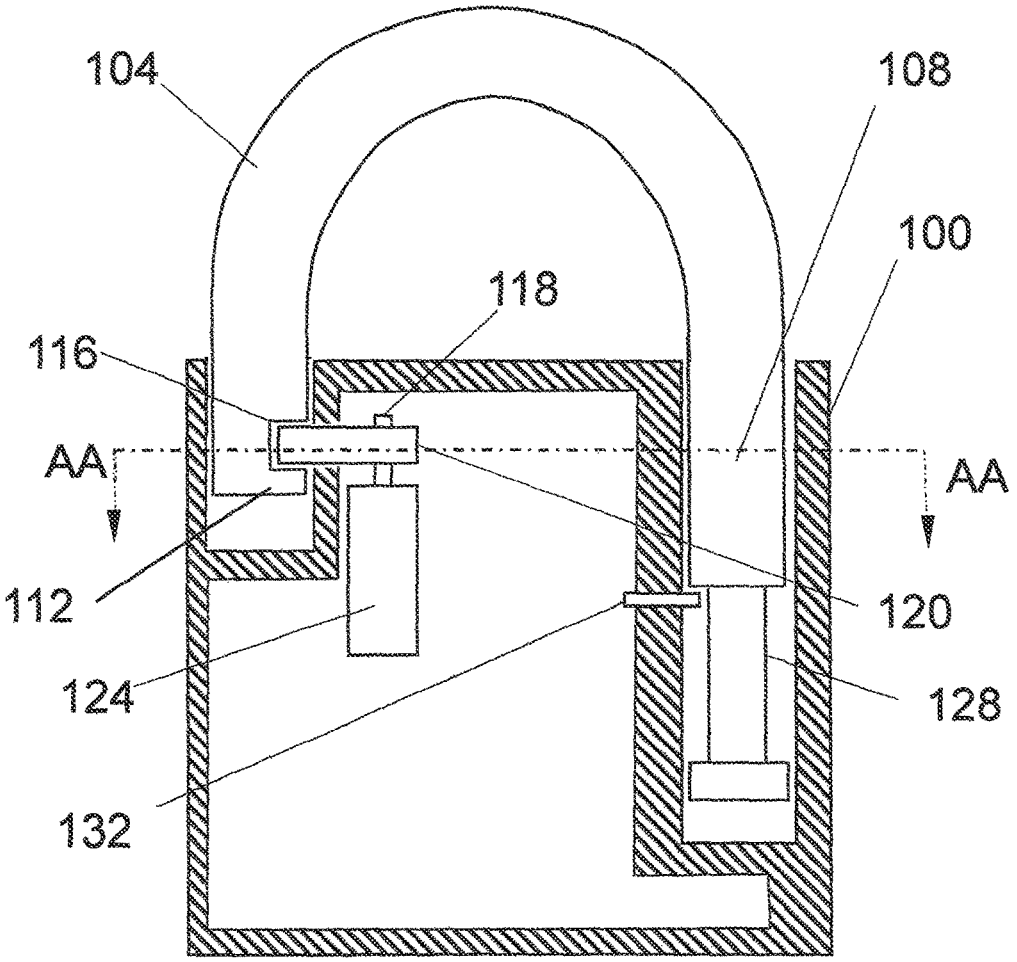
FIG. 1A is a cross sectional view of a common type of portable lock in use today.

FIG. 1A is a front cutaway view showing the interior of a representative example of a common type of portable lock in use today. Unlocking the shackle 104 is accomplished via the retraction of a shackle interposer cam 120 that renders the shackle 104 immobile. The shackle interposer cam 120 can be moved to the locked or unlocked position by a mechanical key lock cylinder, a solenoid, by an electric motor 124 as shown in FIG. 1A, or any other method of imparting mechanical motion. This style of lock is found in key operated locks as well as electrically operated portable locks. The locking and unlocking portion of the shackle 104 is referred to as the shackle toe 112. Within FIG. 1A, the shackle 104 is locked and unlocked only at the toe end 112 of the shackle 104.

The lock is composed of a lock body 100 manufactured of steel, zinc, brass or other metals or alloys of metals as well as plastic or polymers which is used with a shackle 104 that can be manufactured of steel, brass, metal alloys, plastic, nylon or other materials. The shackle heel 108 is the end of that shackle 104 that does not open when the lock is unlocked and is not normally removable from the lock body 100 although it is allowed to freely rotate and move vertically when the shackle 104 is in the unlocked or open state.

The amount of vertical travel of the shackle 104 within the lock body 100 is limited by the travel of the shackle lock pin 132 between the top and bottom edge of the shackle lock pin slot 128. The shackle lock pin slot 128 serves to retain the shackle heel 108 within the lock body 100 when the lock is unlocked or open.

When the lock is secured or closed the shackle toe 112 which is the end of the shackle 104 that opens when the lock is unlocked is held in position by the interference between the shackle interposer cam 120 and the shackle interposer notch 116 until such time as a lock motor 124 rotates the lock motor shaft 118 and causes the shackle interposer cam 120 to rotate and vacate the shackle interposer notch 116.

Figure 1B:
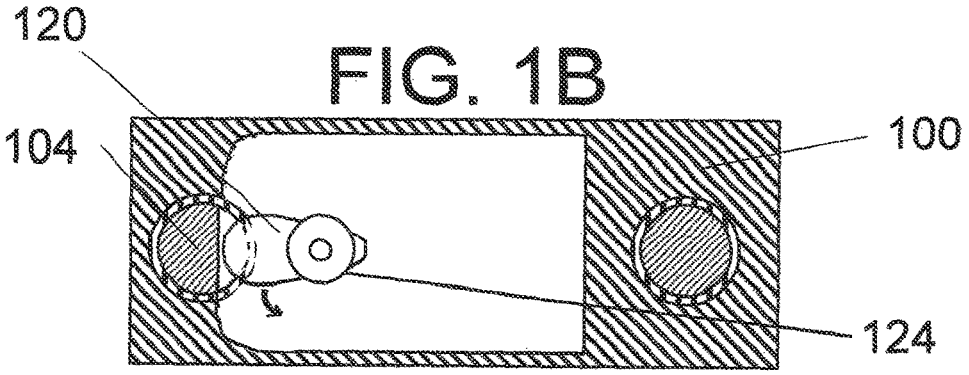
FIG. 1B is a cross-sectional view of the lock of FIG. 1A, taken along the line AA-AA.

FIG. 1B is a cross sectional view of cut-line AA made within FIG. 1A and provides a visual perspective of the interaction between the shackle interposer cam 120 and the shackle 104. This example uses an electrical motor 124 to open the lock. The lock activity described in FIG. 1A and FIG. 1B would also apply to a solenoid lock, or a key operated lock, that is, without a motor 124.

The first embodiment of the shackle 204 has (at least) sub-embodiments 204-1, 204-2, and 204-3. These all have in common that they are rigid. They differ in that the shackle 204-1 can be rotated in 360 degree amounts during a removal process, the shackle 204-2 can be rotated in 180 degree amounts during a removal process, and the shackle 204-3 requires both rotation but also movement through a spiral channel.

None of the embodiments within this disclosure are meant to completely replace adjustable-length shackles, which serve a purpose not addressed by the embodiments disclosed herein. However, in the event that an adjustable-length shackle is broken but its lock-body remains intact, the various embodiments disclosed herein can potential work within most lock-bodies. Thus, the embodiments disclosed herein can be substituted for an adjustable-length shackle. Although the resulting lock-effect will be different, it should still be functional.

Figure 2A:
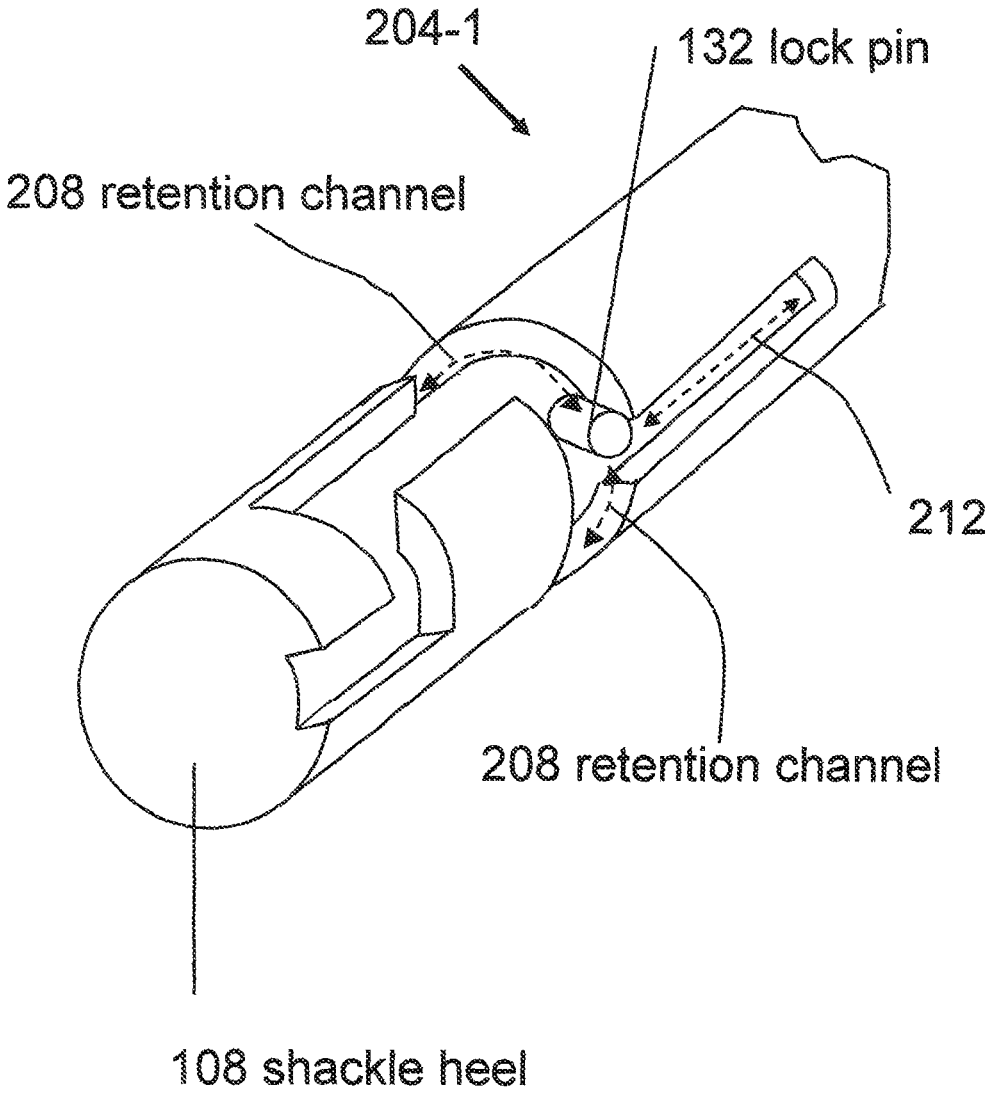
FIG. 2A is a perspective view of the first exemplary embodiment of a removable shackle.

FIG. 2A illustrates a first embodiment shackle 204-1, including a shackle heel 108 at its end. This embodiment can be accomplished with no alteration of an existing lock design or manufacturing specification, other than the shackle 204-1. That is, any and all modifications required to an existing lock product are performed solely upon the first embodiment shackle 204-1, and not, for example, on the lock body. The shackle lock pin retention channel 208 can be the same as used in the standard shackle 104. When the first embodiment shackle 204-1 is installed in a lock body, e.g. the lock body 100, the exposed end of the shackle lock pin 132 (permanently affixed to the lock body 100) is always protruding either into the shackle lock pin retention slot 212 or into the shackle lock pin retention channel 208. It is important to remember that certain elements (e.g. pin retention channel 208, pin retention slot 212) are actually spaces, gaps, apertures, or the absence of a certain material.

Figure 2B:
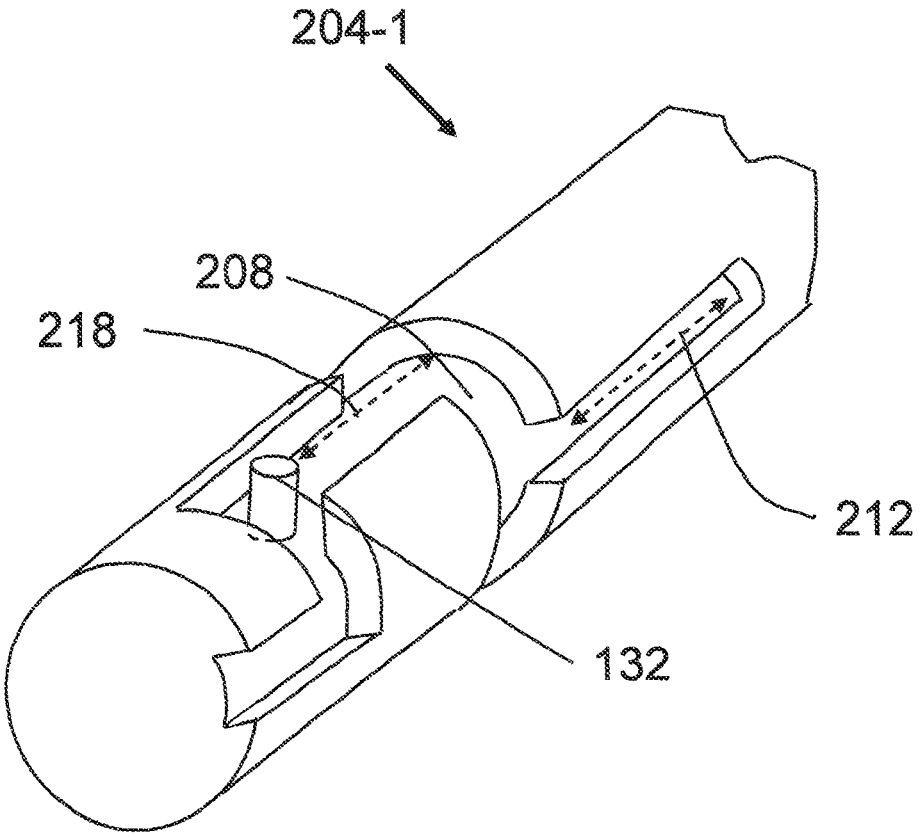
FIG. 2B is another perspective view of the redesigned first embodiment shackle.

FIG. 2B illustrates the shackle modifications performed to the heel 108 of the first embodiment shackle 204-1 to permit insertion and removal from the lock body without the aid of any tools. A shackle lock pin 132 is shown for reference to illustrate its relationship with the various channels machined into the first embodiment shackle 204-1. As stated, the shackle lock pin 132 is solidly affixed to the lock body 100 (not shown in FIG. 2B). The lower left corner of FIG. 2A shows the bottom of the heel 108. The arrow 216 shows the direction the first embodiment shackle 204-1 must be moved, relative to the lock body 100, in order to achieve extraction.

The embodiments herein provide a simple "no tools required" process to allow shackle removal and installation, but without compromising the safety and strength of the entire lock system. Further, the embodiments herein also ensure that the shackle be reasonably prevented from becoming detached accidently.

Accidental shackle detachment is only possible when the lock is open. Thus, accidental shackle detachment is not a security exposure, but is an annoyance. The embodiments herein take steps to minimize this possibility. Accordingly, removing shackle 204-1 involves rotating and moving it vertically within the confines of the lock body 100 in the fashion and sequence dictated by the design of the particular version of shackle 204-1, 204-2, . . . **204-*n* (hereinafter collectively referred to as shackles 204**, that is, in the plural and with no subscript).

Moving back specifically to shackle 204-1, in order to rotate the shackle heel 108, the lock must be unlocked allowing the toe 112 end of the first embodiment shackle 204-1 to be extracted from the lock body 100, or the first embodiment 204-1 shackle must be cut or broken to allow the heel 108 side of the shackle 204-1 to be rotated independently of the locked toe 112 side.

Figure 2C:
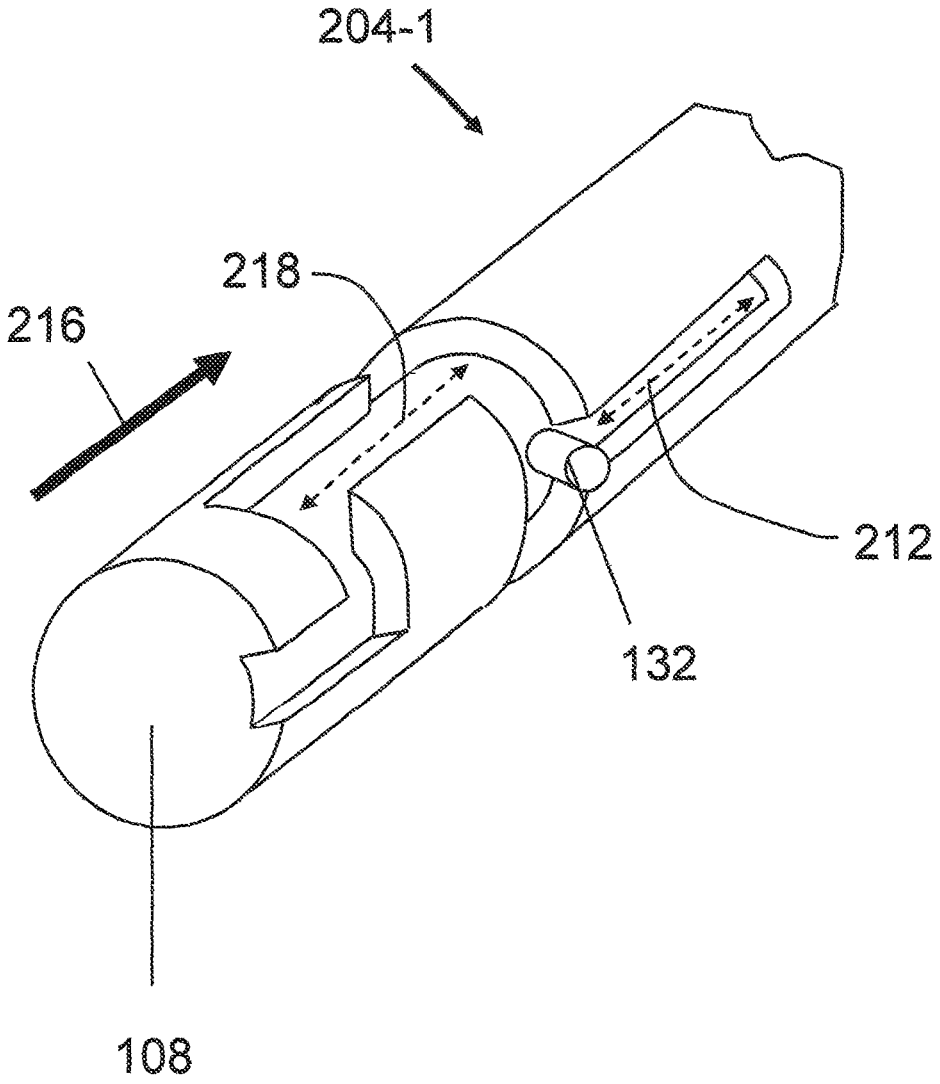
FIG. 2C is another perspective view of the redesigned first embodiment shackle.
Figure 2D:
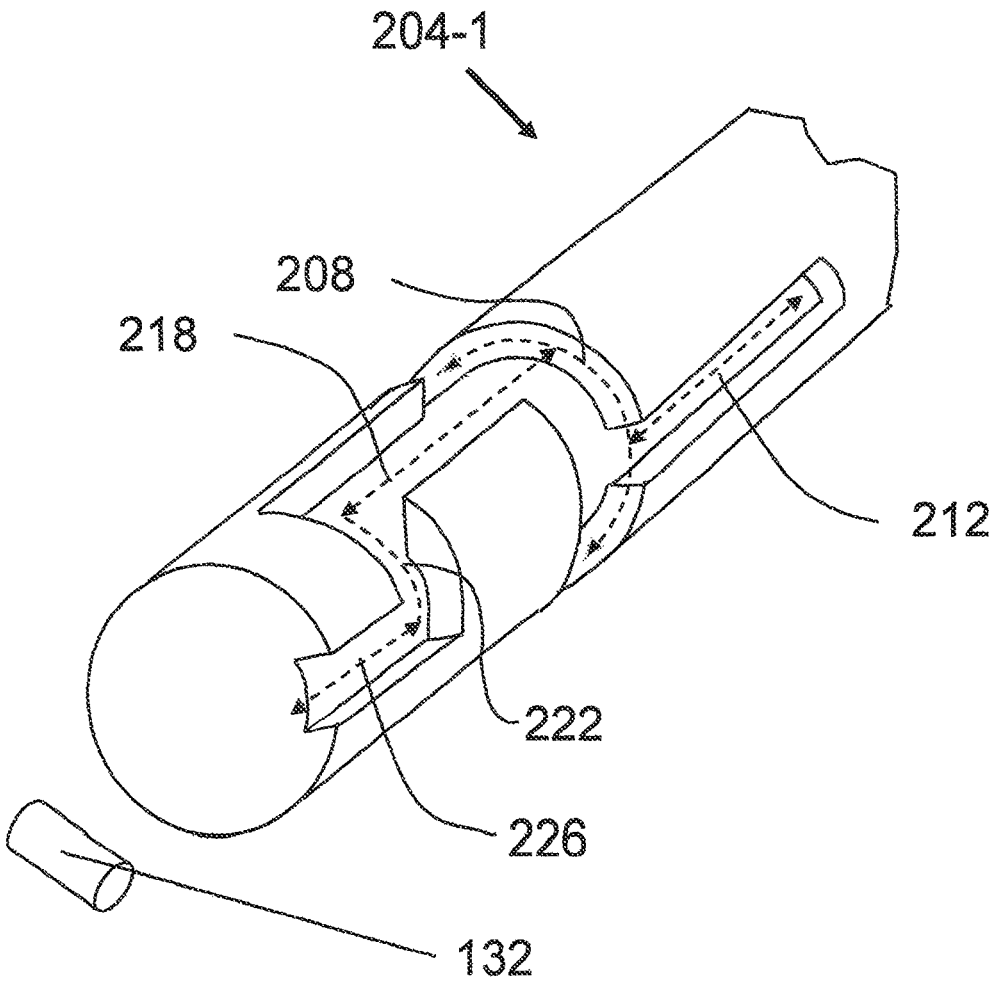
FIG. 2D is a perspective view after the first embodiment has been removed.

The following operational steps must be followed to remove the first embodiment shackle 204-1:

1. The lock must be unlocked, or the installed shackle 204-1 must be cut to ensure the heel 108 side of the shackle 204-1 can be rotated.
2. Pull the shackle 204-1 upward in the direction of the arrow 216 until it is stopped. FIG. 2B shows the change in position of the shackle lock pin 132 relative to the shackle 204-1. The shackle lock pin 132 is now positioned such that the first embodiment shackle can be freely rotated three hundred sixty (360) degrees in the shackle lock pin retention channel 208.
3. Pull upward (away from the lock body 100) and rotate the shackle 204-1 in either direction until it is coincident with the level two (2) channel 218. The shackle 204-1 will then be allowed to move upward until it is limited by the bottom of the level two (2) channel. The resulting relative position of the shackle lock pin 132 to shackle 204-1 is represented by FIG. 2C.
4. While still pulling up on the first embodiment shackle 204-1, rotate the first embodiment shackle 204-1 in the only direction allowed by the level three (3) channel 222. When the first embodiment shackle 204-1 is moved far enough the shackle lock pin 132 will be coincident with the extraction channel 226 and the first embodiment shackle 204-1 will be removed.

To install the replacement shackle 204-1: Reverse the above removal steps. At the point where the 204-1 is installed, the lock is then restored to operational status.

Figure 3:
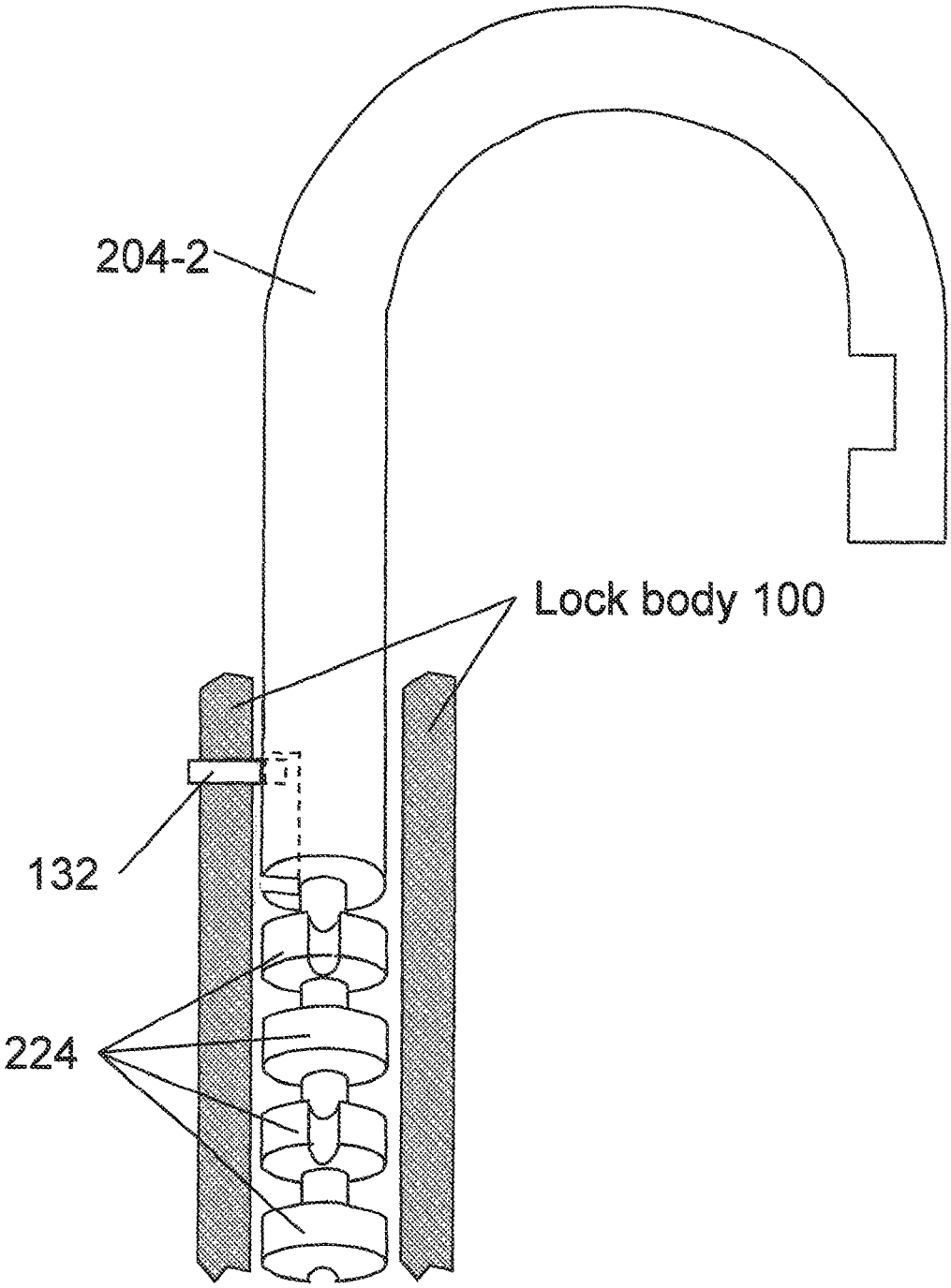
FIG. 3 is a cross sectional view of one of many variants that can be applied to the first embodiment shackle design.

FIG. 3 illustrates yet another of the many variants that can be applied to the first embodiment shackle design, which will be designated as first embodiment shackle 204-2. The shackle 204-2 is depicted including, as with all embodiments herein, the enhancements necessary to make it removable without tools. The ability to extract the first embodiment shackles 204 without tools allows the removal at any time when the first embodiment shackles 204 is not locked within the lock body 100.

When the lock body 100 is closed/locked, the first embodiment shackle 204-2 is mechanically retained within the lock body 100 so that the shackle 204-2 cannot be removed. However, the ability to inadvertently remove the first embodiment shackle 204-2 does exist if the lock body 100 is open. It is anticipated that this exposure is again minimal and should not cause any user dissatisfaction. More overt actions are required for removal of the first embodiment shackle 204-2, thus decreasing the potential for user annoyance caused by the possibility of an accidental removal when the lock body 100 is in an unlocked position.

The shackle 204-2 has four (4) shackle extraction cams 224. Each shackle extraction cam 224 adds a one hundred and eighty (180) degree rotation of the shackle 204-2 that must be performed to insert or remove a first embodiment shackle 204-2.

More or less shackle extraction cams than the four shown in FIG. 3 may be included in the shackle 204-2, the exact number being constrained only by the limits imposed by the lock body 100 length and the embodiment one shackle 204-2 length. The shackle lock pin 132 is the component that controls rotational and vertical movement of the first embodiment shackle 204-2 within the lock body 100.

Figure 4A:
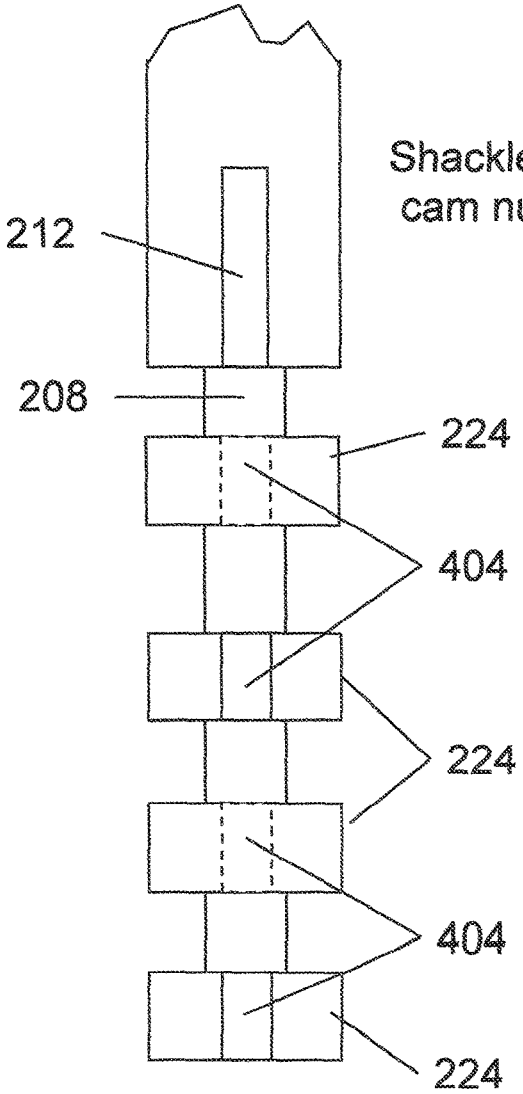
FIG. 4A is a front view of first embodiment shackle construction details.

FIG. 4A illustrates construction aspects and components of the heel 108 portion of this version of the first embodiment shackle 204-2. The first embodiment shackle 204-2 is manufactured using e.g. steel, an alloy of multiple metals, plastic, nylon, or any other material having sufficient manufacturing characteristics. One possible method of manufacture is to machine up base metal shackle bodies, and then machine-cut or grind the features exhibited within FIG. 4A including shackle extraction cams 224 and any required channels including but not limited to the shackle lock pin retention slot 212, the shackle lock pin retention channel 208, and the extraction cam lock pin channels 404.

An alternative manufacturing method would be to manufacture the first embodiment shackle 204-2 keeping the portion of the shackle heel 108 that extends down from the bottom of the shackle lock pin retention slot 212 at the same diameter as the shaft diameter used as the shackle lock pin retention channel 208, and then welding the shackle extraction cams 224 to the main shackle body 204-2. The diameter of the center holes in the extraction cams 224 are such that they can be slid onto the shackle heel 108 and positioned to be attached to the shackle heel 108 and rotated such that the extraction pin channels 404 can be aligned as desired.

The placement of the extraction pin channels 404 can be chosen from a variety of patterns, as long as these channels 404 are not vertically aligned. The extraction channels 404 being vertically aligned would thwart the intention of preventing accidental shackle extraction by allowing the removal of the first embodiment shackle 204-2 in only two (2) motions, one motion being to rotationally align shackle lock pin retention slot 212 in shackle extraction cam 224 number (1) with the shackle lock pin 132 and the second motion 2 would be to pull upward on the first embodiment shackle 204-2. With the shackle lock pin slots 404 in alignment such a single upward pull would cause the first embodiment shackle 204-2 to clear all four (4) shackle lock pin slots 404, thereby clearing the shackle lock pin 132 in one motion which would allow complete removal in two motions.

It is anticipated that two (2) extraction cams 224 would offer adequate deterrence against accidental shackle extraction. However, for clarity, the depictions in the first embodiment version 2 disclosure contain four extraction cams 224 to better illustrate the degree of deterrence that can be obtained with a larger number of extraction cams 224.

Figure 4B:
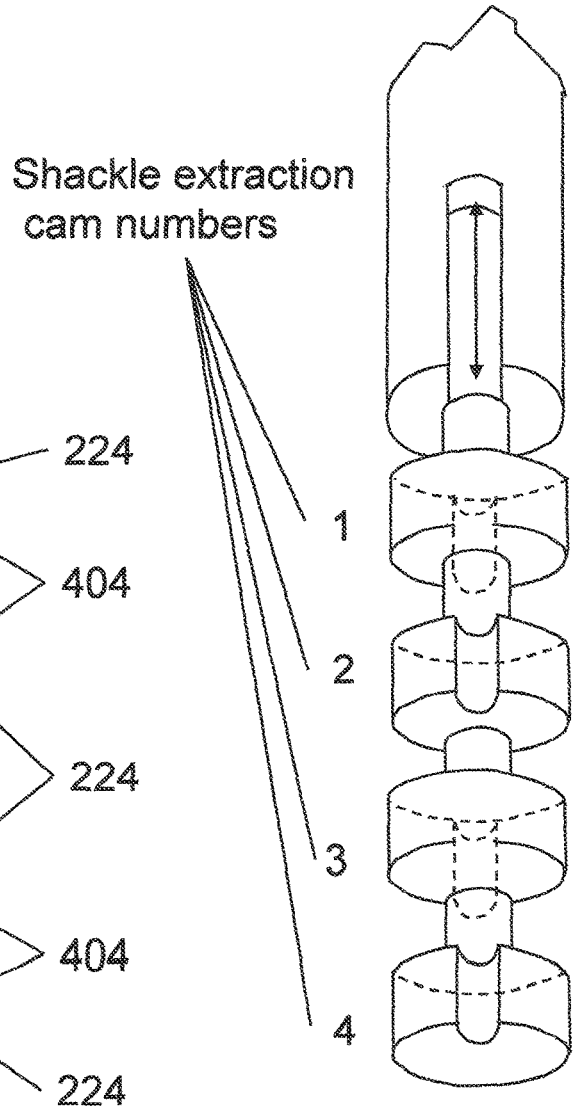
FIG. 4B is a perspective view of first embodiment shackle construction details.
Figure 5A:
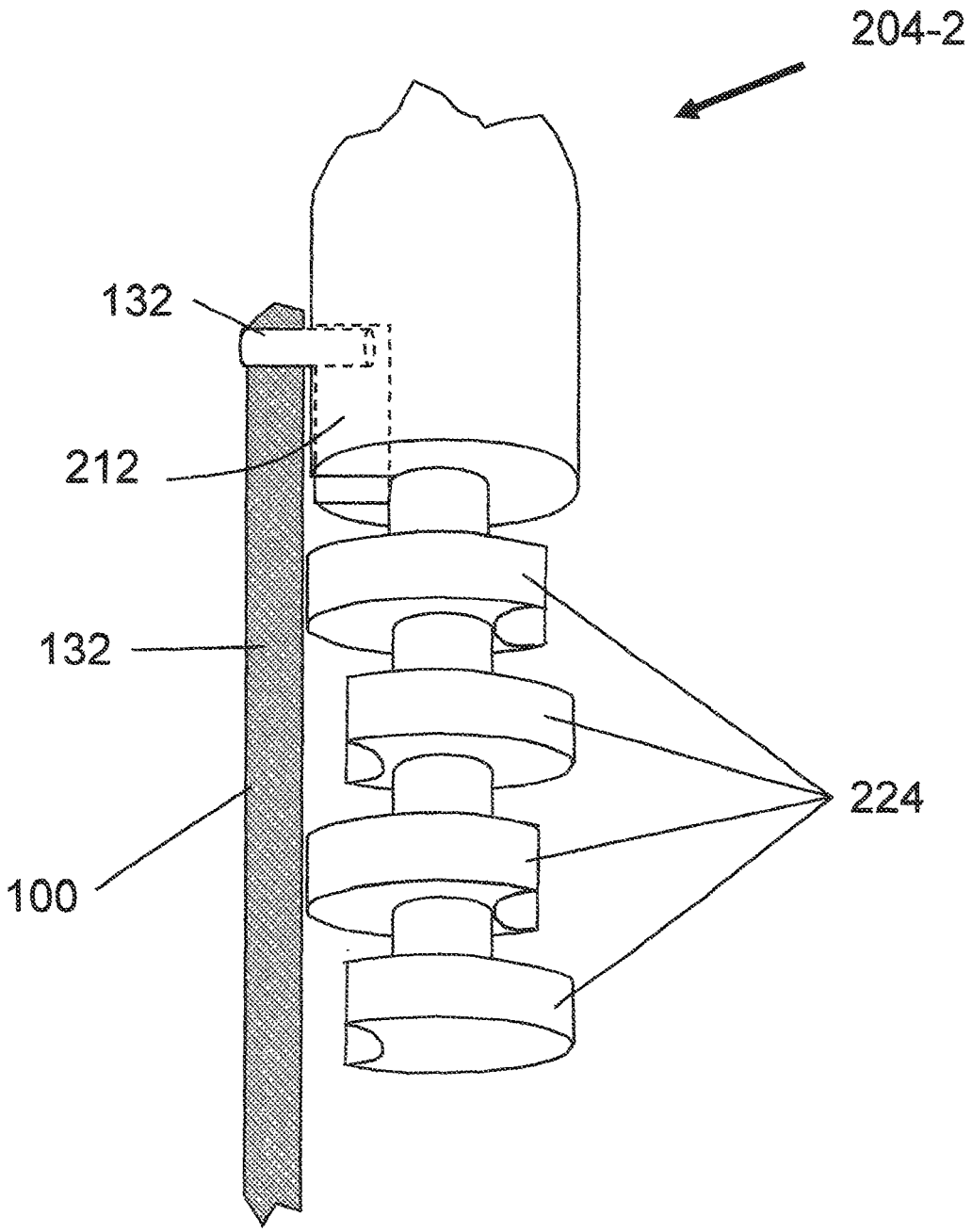
FIG. 5A is a perspective view of first embodiment disassembly step 1.

FIG. 5A is a perspective view of the same components illustrated in FIG. 4A and FIG. 4B. A cut away portion of the lock body 100 and a shackle lock pin 132 is shown affixed to the lock body 100. The shackle lock pin 132 can be pressed into place, threaded into the lock body 100, welded to the lock body 100 or attached in any other mechanically sound method. An additional variant is the exact shape of the extraction cam lock pin channels 404. The shape of the cam 224 need not be exactly as shown in FIGS. 2-4. That is, it is not necessary for size and shape of the cams 224 to be precise and require significant effort to be aligned with the shackle lock pin 132. Rather, the intention is to require a user to exert a very slight upward pressure (pulling the shaft away from the lock body 100), rotate the first embodiment shackle 204-2 until the extraction pin channel 404 coincides with the shackle lock pin 132 and the shackle lock pin 132 slides thru the extraction cam lock pin channels 404 until it strikes the surface of the next extraction cam 224.

The process of manufacturing the cams 224 can be varied to find a balance between lowest manufacturing cost, lowest manufacturing time, yet highest productive use without jamming or sticking, including making alterations to the exact shape of the cams 224. That is, a variety of shapes for the cams 224 can be considered. Further, within any individual shackle of the present embodiments, not all cams 224-1 through **224-*n* need be the exact same shape. Manufacturing conditions may exists where a shackle (e.g. shackles 204**) can be machined using more than one cam-shape, and where doing so is cost-effective and passes all quality and use-tests.

Note that within FIG. 5A, the shackle lock pin 132 is positioned at the top of the shackle lock pin retention slot 212 which would be the case when any of the first embodiment shackles 204 are in the locked position.

Figure 5B:
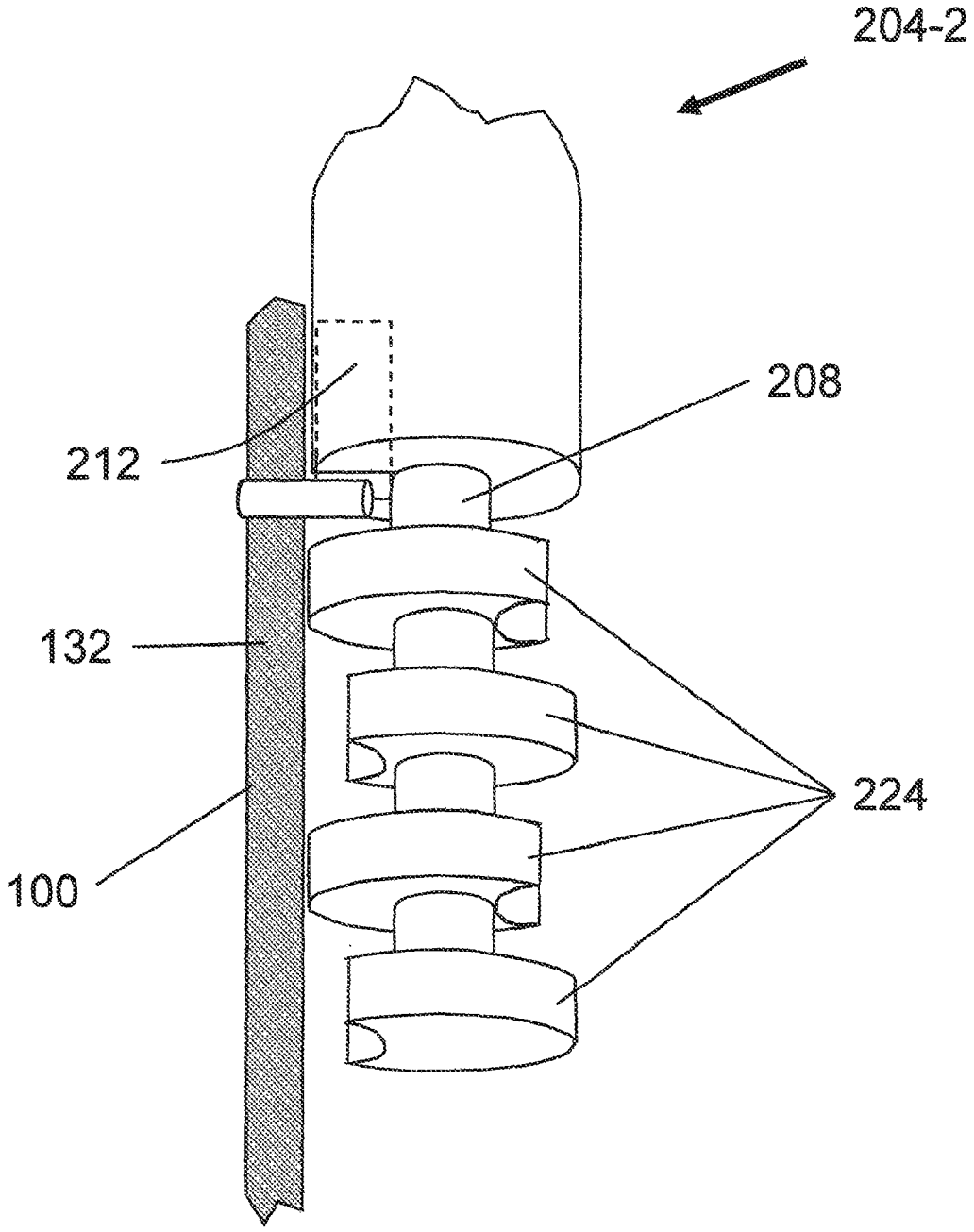
FIG. 5B is a perspective view of first embodiment disassembly step 2.

FIG. 5B shows the shackle lock pin 132 positioned in the pin retention channel 208. When the unit is not locked and the shackle 204-2 is in the open position, the shackle lock pin 132 is placed in the pin retention channel 208 which allows the first embodiment shackle 204-2 to be freely rotated. The upward travel of the first embodiment shackle 204-2 is limited by its impingement with the top surface of the uppermost extraction cam 224.

FIG. 5C thru FIG. 5G illustrate how the first embodiment shackle 204-2 can be removed from the lock body 100 starting at the unlocked position depicted in FIG. 5B.

Figure 5C:
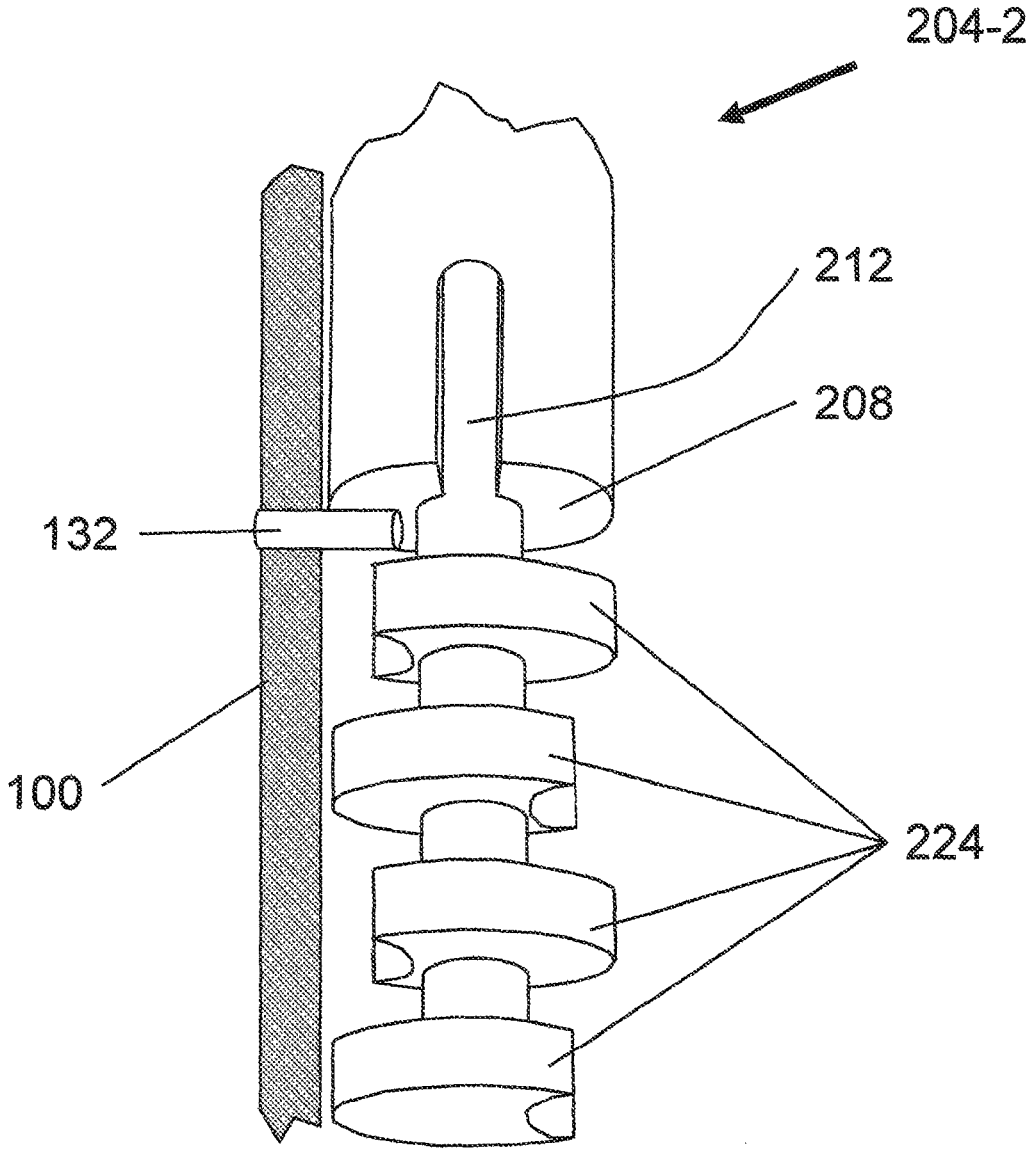
FIG. 5C is a perspective view of first embodiment disassembly step 3.

FIG. 5C is the result of performing step 1 of the first embodiment shackle 204-2 removal process.

Step 1 is accomplished by rotating the first embodiment shackle 204-2 while maintaining a slight upward pull thereupon. An alternative to tugging upward on the shackle is to hold the lock body upside down and let gravity cause downward movement of the shackle. In either case, when the pin extraction channel 404 coincides with the shackle lock pin 132, the first embodiment shackle 204 will move upward as the shackle lock pin 132 passes thru the opening (e.g. pin extraction channel 404) and then be impinged by the top surface of the next extraction cam 224 which is shown in FIG. 5D.

Figure 5D:
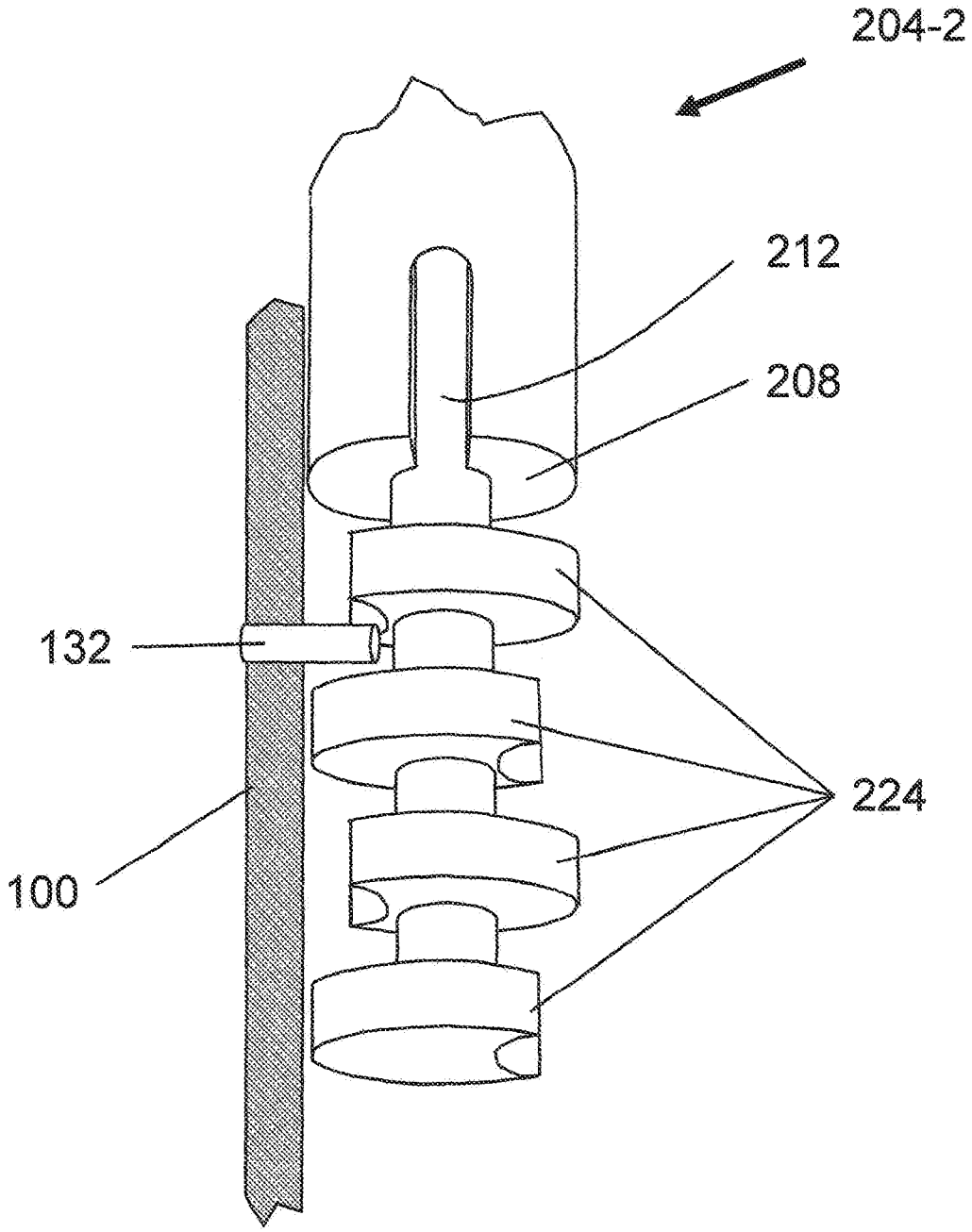
FIG. 5D is a perspective view of first embodiment disassembly step 4.

FIG. 5D is the result of performing the actions described in FIG. 5C.

Step 2 is performed by again rotating the first embodiment shackle 204 until such time as there is coincidence between the shackle lock pin 132 and the extraction channel 404 on the second extraction cam 224. At that time, the first embodiment shackle 204-2 will move upward as the shackle lock pin 132 passes thru the opening and then be impinged by the top surface of the next extraction cam 224, and the shackle lock pin 132 will rest against the top surface of the third extraction cam 224 from the top as shown in FIG. 5E.

Figure 5E:
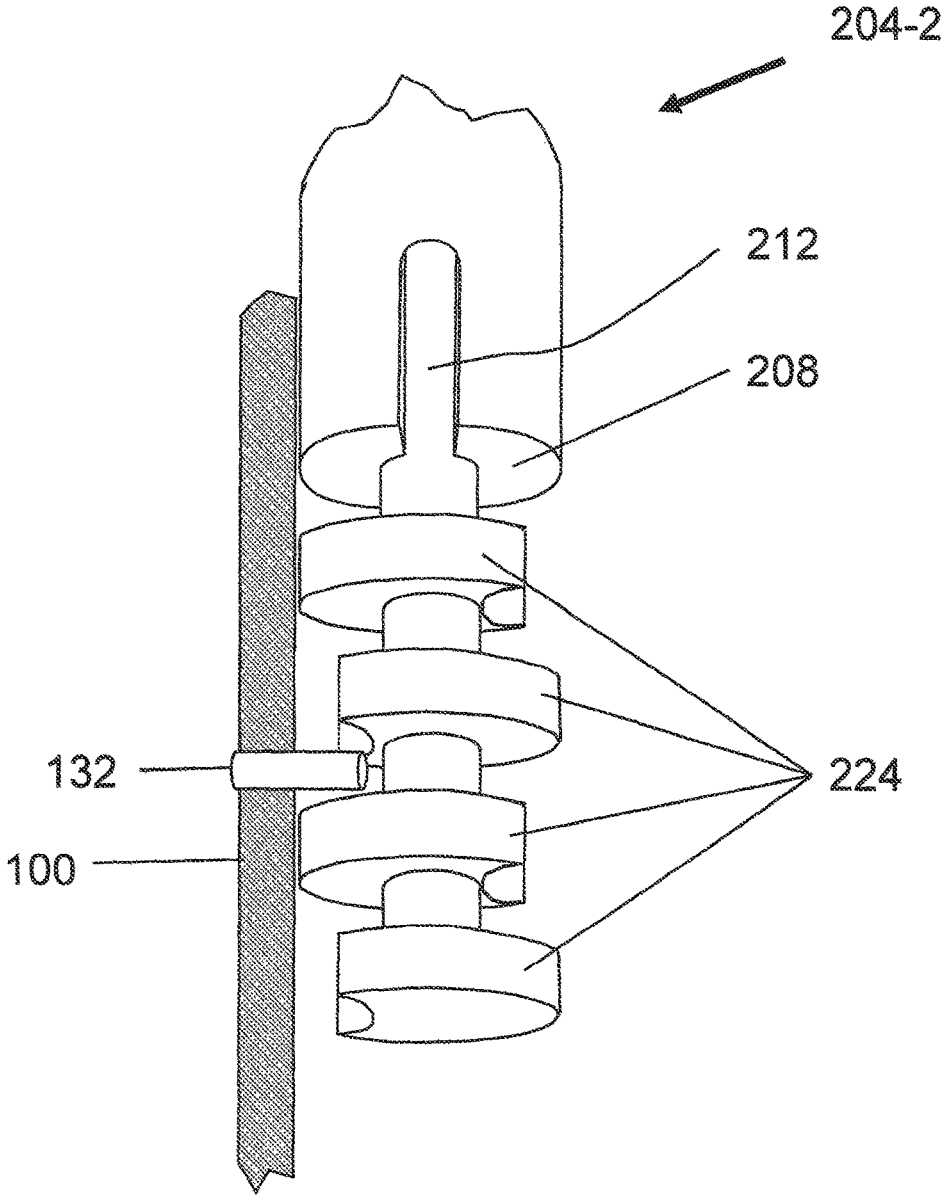
FIG. 5E is a perspective view of first embodiment disassembly step 5.

FIG. 5E is the result of performing the actions described in FIG. 5D.

Step 3 is performed by again rotating the first embodiment shackle 204-2 until such time as there is coincidence between the shackle lock pin 132 and the pin extraction channel 404 on the third extraction cam 224. At that time the first embodiment shackle 204-2 passes thru the pin extraction channel 404 and the shackle lock pin 132 will rest against the top surface of the fourth or bottom extraction cam 224 from the top as shown in FIG. 5F.

Figure 5F:
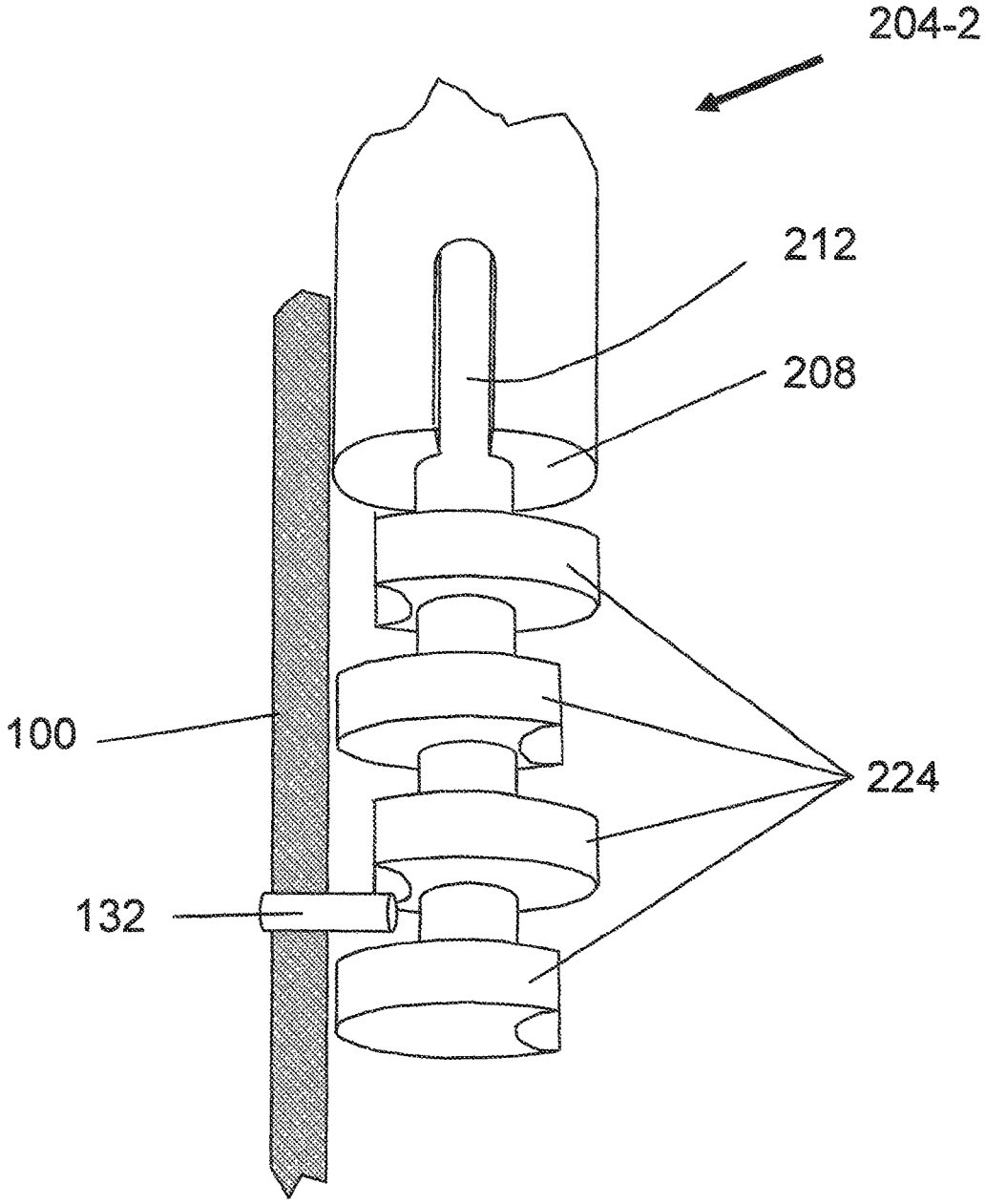
FIG. 5F is a perspective view of first embodiment disassembly step 6.
Figure 5G:
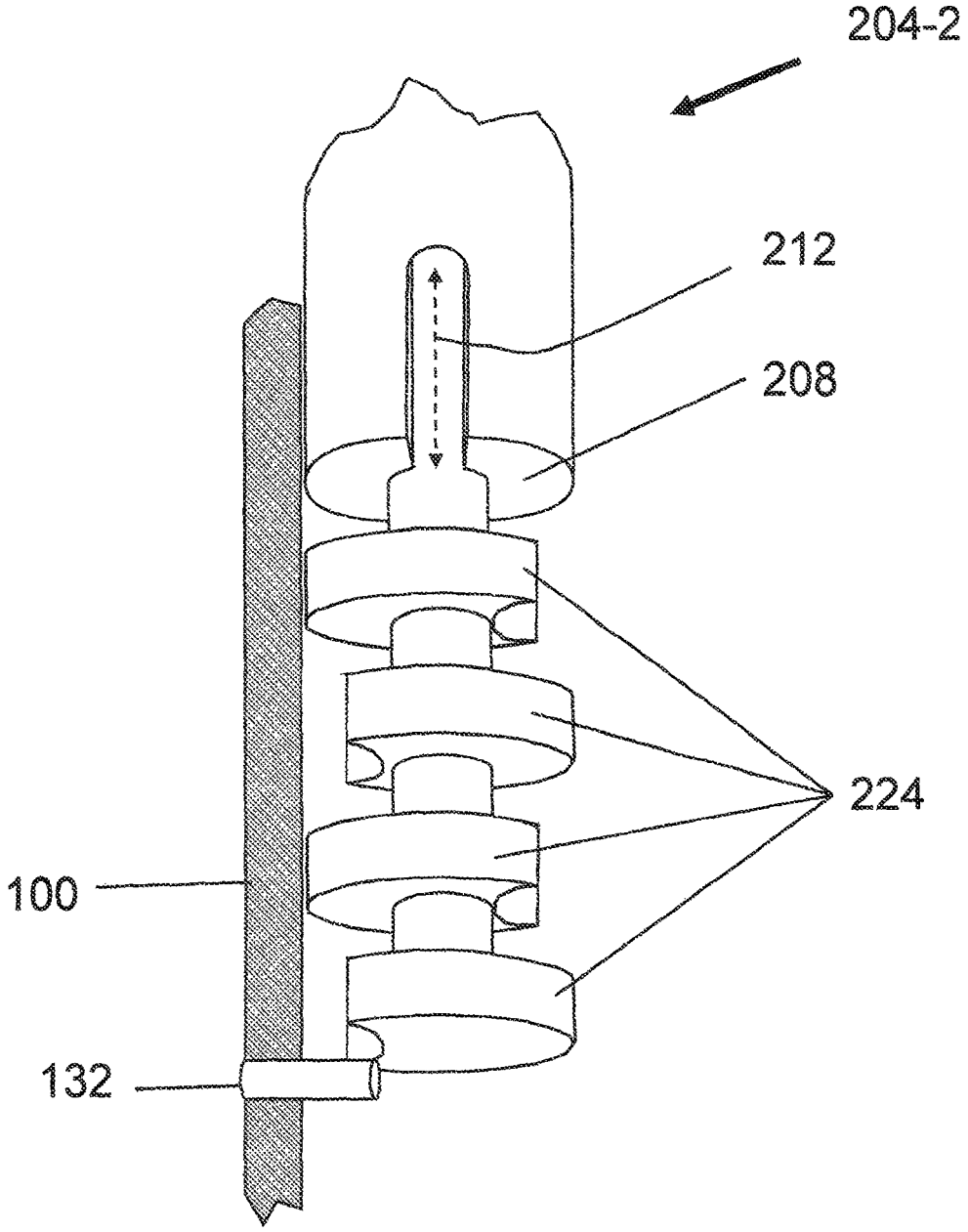
FIG. 5G is a perspective view of first embodiment disassembly step 7.

FIG. 5F is the result of performing the actions described in FIG. 5E.

Step 4 of the removal process shown on FIG. 5G is accomplished by again rotating the first embodiment shackle 204-2 until such time as there is coincidence between the shackle lock pin 132 and the extraction cam lock pin channel 404 on the fourth extraction cam 224. When the first embodiment shackle 204-2 passes thru the opening, the shackle lock pin 132 will no longer be in contact with any part of the first embodiment shackle 204-2 and the shackle can be completely extracted from the lock body 100.

To re-install the same first embodiment shackle 204-2 or a different compatible shackle of the same design, reverse the above defined steps.

FIG. 6A is a frontal cut away view illustrating yet another of the many variants that can be applied to the first embodiment shackle 204 design. This first embodiment shackle 204 is removed from the lock body 100 in a continuous rotational motion that can be determined by the direction of the spiral extraction channel 652.

When the shackle interposer cam 120 is withdrawn from the interposer notch 116 in the toe 112 of the first embodiment shackle 204-3, the unimpeded first embodiment shackle 204-3 can be moved upward and the toe 112 end of the first embodiment shackle can be moved upward far enough to allow the toe 112 to clear the opening within the toe tube 628. The upward motion of the first embodiment shackle is impeded by the top of the heel tube limiter 636 striking the shackle lock pin 132. The first embodiment shackle 204-3 can be rotated three hundred sixty (360) degrees at any time the toe 112 is clear of the opening within the toe tube 628.

Figure 6C:
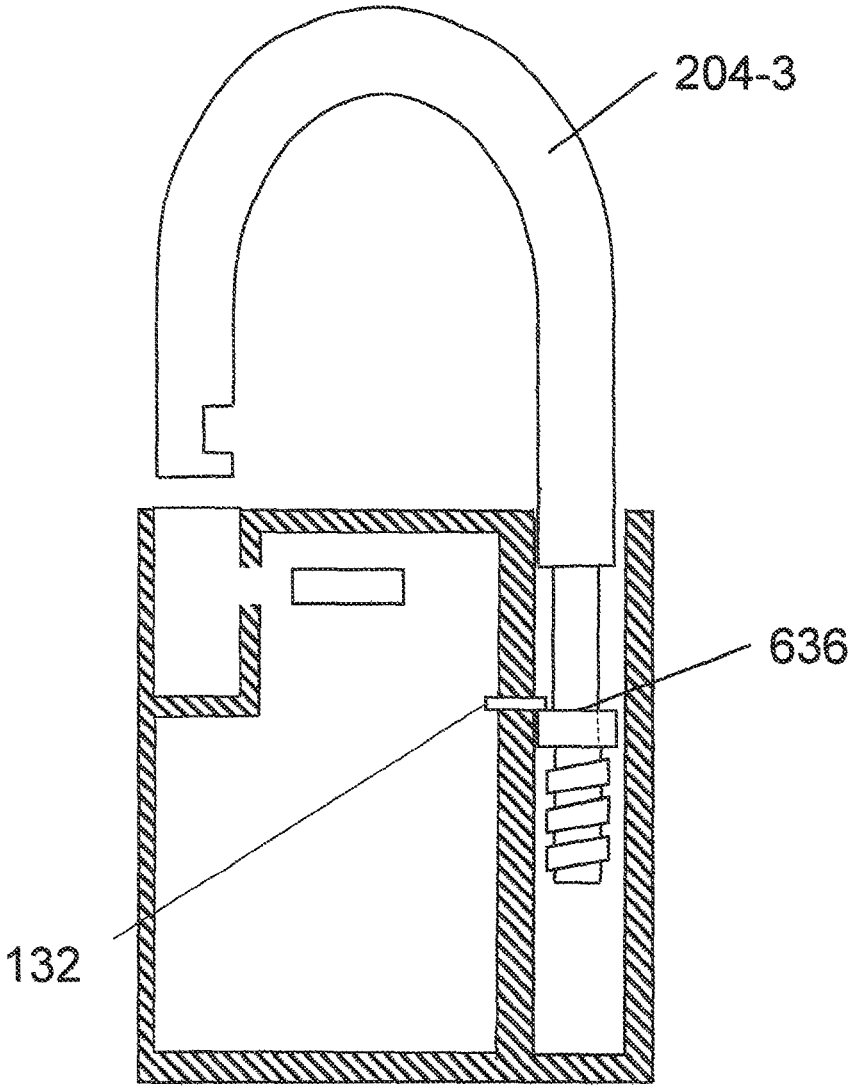
FIG. 6C is a cross sectional view showing disassembly of the variant of FIG. 6B.

FIG. 6B is a view of the embodiment of FIG. 6A, taken along the section-line BB-BB. FIG. 6B illustrates the relationship between the heel tube 608, the inner diameter 648, the inside diameter of the shackle lock pin slot 644, and the shackle lock pin slot 640. Note the dimensions of the spiral extraction channel 652 are specified to allow the shackle lock pin 132 to fit within the inside portion of the spiral extraction channel 652. Specifically, the inner diameter 648 is used to determine the diameter of the shaft portion of the shackle 204-3. Meanwhile, the inside diameter of the shackle lock pin slot 644 is used to determine the outer diameter of the spiral extraction channel 652. FIG. 6E shows the shackle 204-3 further along in the extraction process, after two full rotations.

To extract the shackle 204-3, it is required that the portable lock be unlocked or the shackle 204-3 be cut to allow vertical movement and rotation of the heel 108 side of the shackle.

The extraction process begins by pulling the shackle 204-3 upward (away from the lock body 100) until it is impeded, and then rotate in either direction until the shackle lock pin 132 is aligned with the shackle lock pin slot 640. The shackle lock pin 132 will pass thru the shackle lock pin slot 640 until it strikes the top of the outer diameter of the spiral extraction channel 652 as shown in FIG. 6C.

Figure 6D:
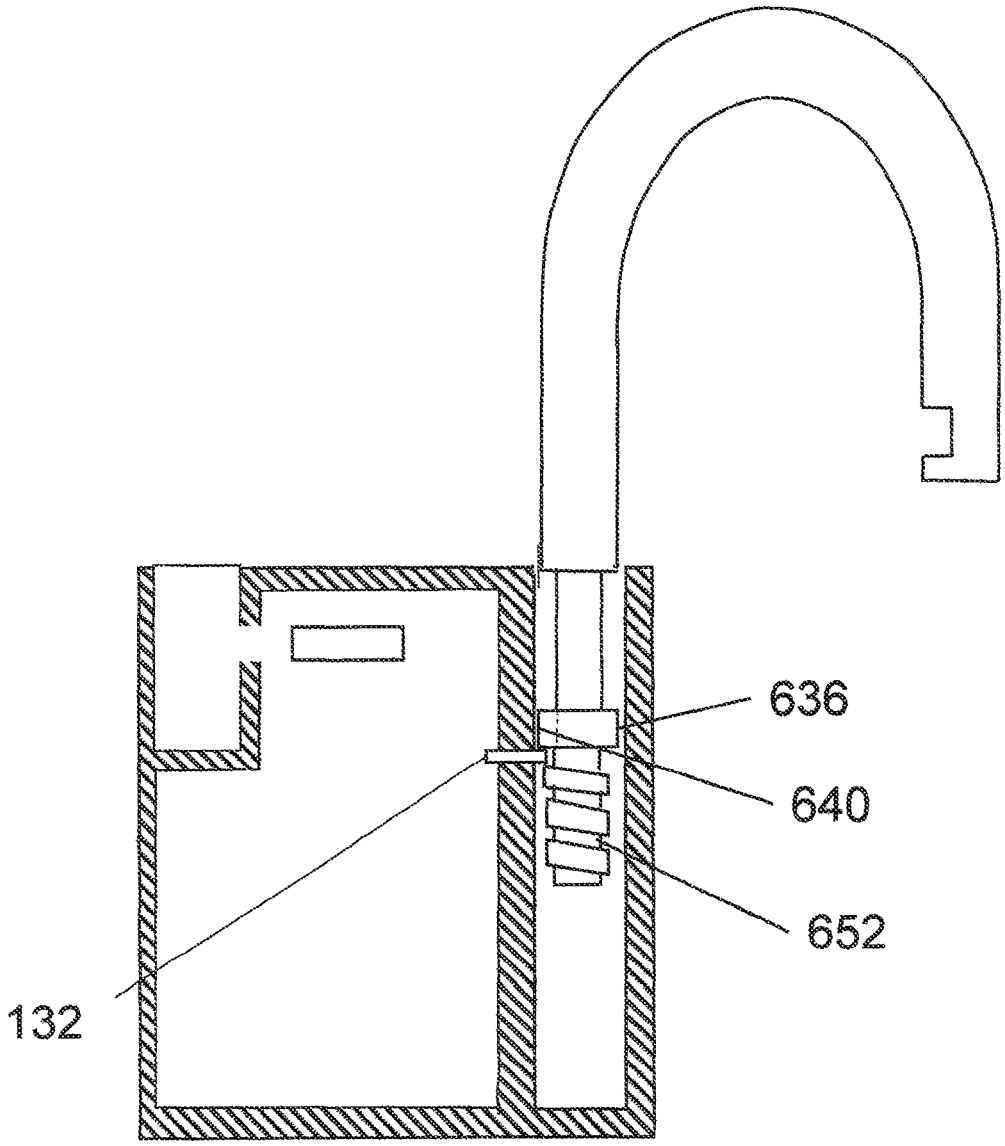
FIGS. 6D-6E are cross sectional views showing an embodiment in various stages of a removal process.
Figure 6E:
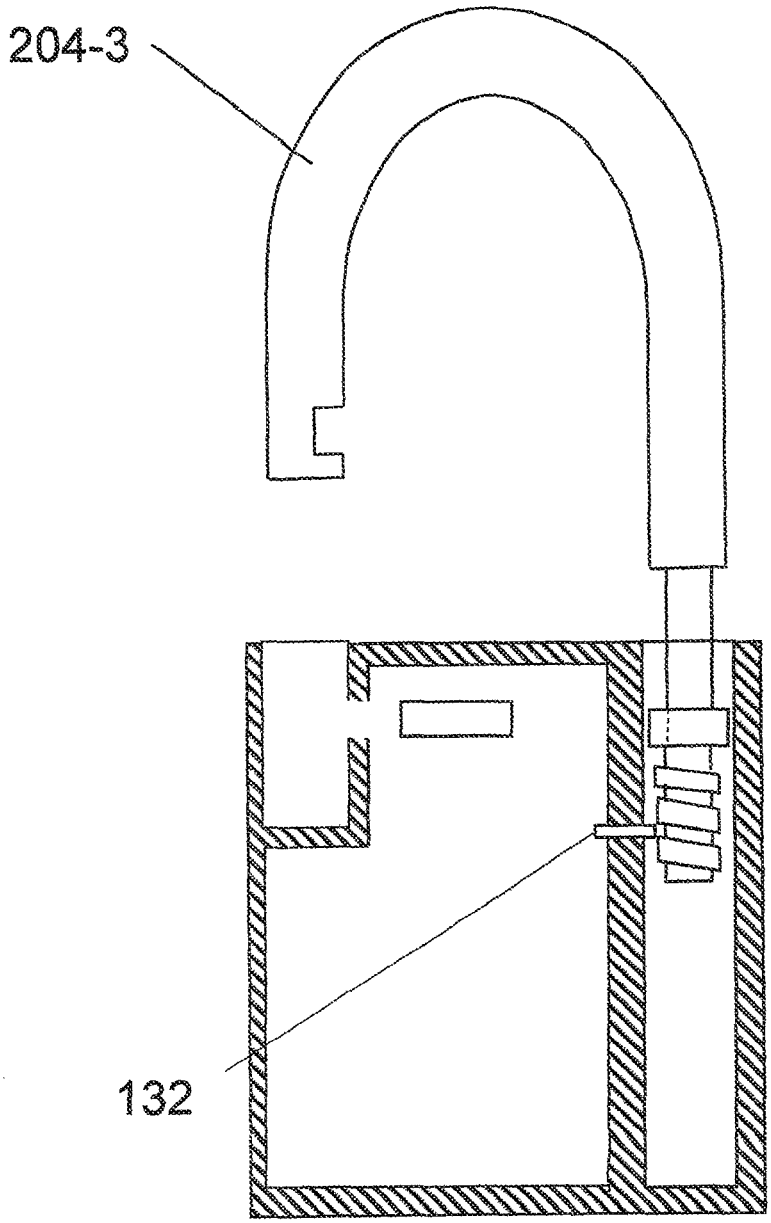

FIG. 6D shows the results of rotating the first embodiment shackle 204-3 in a clockwise or right-hand direction and the shackle lock pin will follow the inner track of the spiral extraction channel as shown in FIG. 6D. The spiral extraction channel 652 can be constructed to make the first embodiment shackle 204-3 be impelled to move upwards when turned clockwise or counter-clockwise. That is, a user unaware of the spiral extraction channel 652 will apply strictly rotational force in a horizontal direction, yet some vertical movement will result.

Yet another additional embodiment consists of adding the same capability to replace or substitute different flexible cable shackles used in portable locks of the same and differing styles as those portable locks utilizing solid shackles. As it is in the use of solid shackles described by the first embodiment, flexible cable shackles are also sometimes cut off in order to remove a lock. In addition, cable locks have variables in specifications and characteristics including but not limited to length, diameter, sheathed or unsheathed cable, rust resistance, cable strength and flexibility. Therefore, a portable cable lock user would benefit from being able replace a cable shackle in as simple a fashion as required to replace a rigid shackle, again requiring no tools or training to do so.

It is important to note that first embodiment rigid shackles and second embodiment cable shackles described by this art can be interchangeably used on the same lock body, provided that the lock body specifications and dimensions are used in the design and manufacture of any lock body designed and manufactured to be compatible with each other. Additionally, if groups of locks similar to the lock body 100 used in this example were identical, a shackle that fit into one of them would also perform just as well on any sample from the rest of the group. The design specifications and characteristics to be considered in the manufacture of shackles, lock bodies and attachment methods to offer compatible and interchangeable components to maximize the advantages of this art will be explained following the disclosures of the solutions proposed herein.

Figure 7:
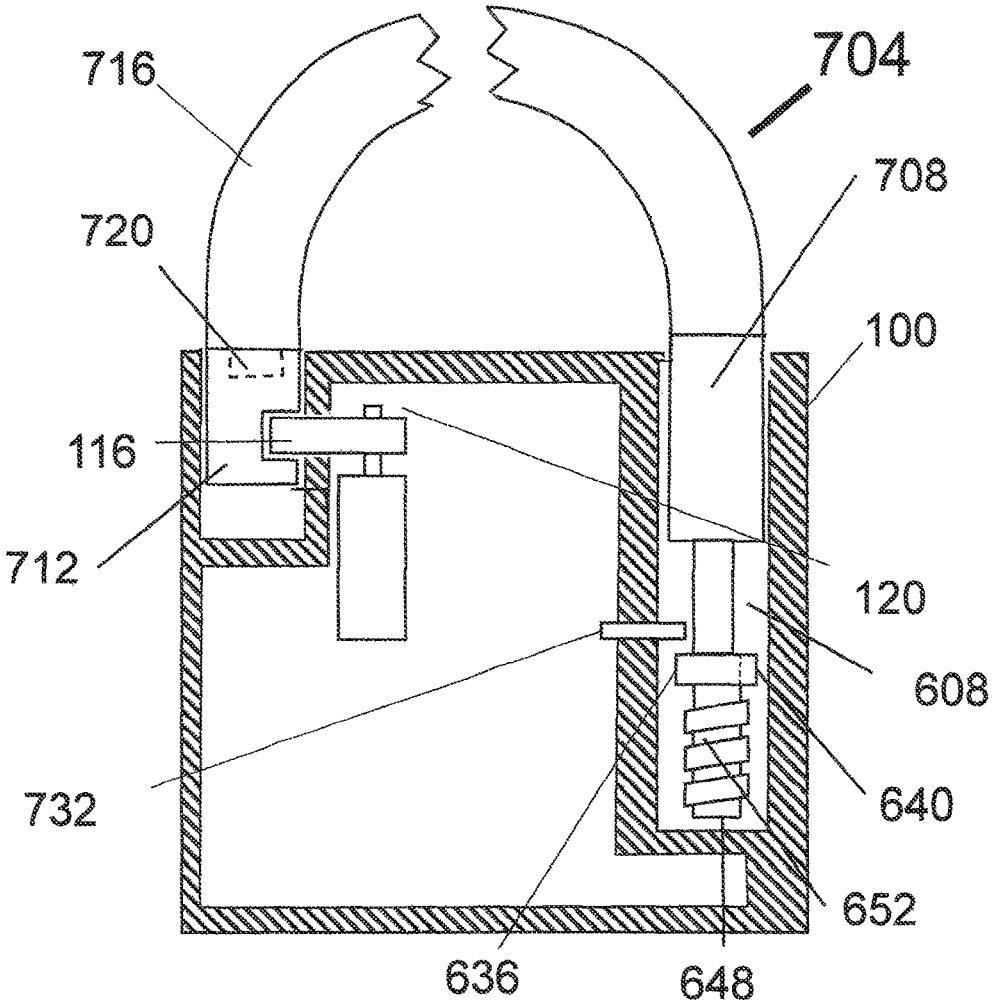
FIG. 7 is a cross sectional view of the second embodiment of the invention.

FIG. 7 will aid in describing the differing requirements and considerations that must be taken into account when presenting all of the replaceable shackle functions for use with flexible cable shackles, similar to the previous description of the first embodiment for rigid shackles.

While portable lock shackles are thought of as a single item, it is necessary to not only think of a shackle in its entirety, but one must often focus on parts and sections of a shackle. The basic second embodiment cable shackle assembly 704 is represented in FIG. 7 and is shown with a break in the cable portion as there is no real limitation on the length or shackle clearance thereof. A rigid shackle such as the first embodiment shackles 204 made from any material is traditionally made in one piece. Meanwhile, a second embodiment cable shackle 704 has a solid second heel section 708 and a solid toe section 712, but also has a cable 716 joined to the heel 708 and toe 712. Thus, the second embodiment shackle 704 may be an assembly of parts. However, a unified 1-piece embodiment also exists.

FIG. 7 depicts the same portable lock previously referred to as lock body 100 in FIGS. 1A and 1B. These FIGS. 1A and 1B are borrowed but modified into FIG. 7 which is intended to help demonstrate the second embodiment.

FIG. 7 again shows the basic cable shackle lock body 100 which is used as the basis for modifications to provide a useful replaceable cable shackle product. It is important to demonstrate how both the first and second embodiments relate to the common lock body 100 as previously discussed. While acknowledging the differences in the two (2) solutions, this disclosure maintains focus upon how to apply each to a common solution consisting of the merger of the common lock body 100 and the two differing shackle embodiments.

Renumbering changes and the rationale behind them are: The references to the shackle type previously identified as "first embodiment shackles 204" which is intended to be manufactured of rigid materials were removed and a second embodiment cable shackle assembly 704 consisting of three identified components: a shackle toe 712, a shackle heel 708 and a shackle cable 716. The second embodiment shackle toe 712 is a rigid metal or other solid material likeness of the same toe end portion of the first embodiment shackles 204. The toe 712 differs in that its end that joins the shackle cable 716 is hollow, which allows a short length of the cable 716 to be inserted within the second embodiment toe 712.

The second embodiment shackle cable 716 and the second embodiment shackle toe 712 are then joined together by swaging, welding or some other mechanically sound joining or fastening method. The shackle heel 708 is a rigid metal or other solid material likeness of the same heel end portion 108 of the first embodiment shackle 204. The shackle heel 708 differs in that the end that joins the cable second embodiment shackle cable 716 is hollow, which allows a short length of the second embodiment cable 716 to be inserted within the second embodiment shackle toe 712. The second embodiment shackle cable 716 and the second embodiment shackle toe 712 are then joined together by swaging, welding or some other mechanically sound method. Within FIG. 7, the second embodiment shackle cable 716 is represented with a break as the typical cable shackle would usually be a minimum of twenty (20) inches in length, so that illustrating the entire cable would detract from the focus on the aspects of the cable ends rather than the cable body. First embodiment shackles 204 and second embodiment cable shackles 704 are generally compatible, and could conceivably work within the same lock body 100.

It is important to notice that the reference number for the shackle lock pin shown in FIG. 1A and FIG. 1B is 132. However, within FIG. 7, this will be shown as cable shackle lock pin 732. In the second embodiment, special consideration must be given for the strength of the cable shackle lock pin 732 in regards to tensile strength and compressive resistance.

There are no specifications provided for length and circumference of either the rigid first embodiment shackle lock pin 132 or the second embodiment shackle 704. This is because within the rigid first embodiment shackles 204, the majority of all lock retention forces including tensile and compression are resisted by the first embodiment shackle toe 112, shackle interposer notch 116, the interposer cam 120, and the lock body 100 which can also be molded to help distribute these forces.

Therefore the design of the rigid first embodiment shackle lock pin 132 insofar as material selection and dimensions is far less critical than the second embodiment shackle lock pin 732, as the cable shackle implementation divides the tensile and compressive forces equally between both ends of the second embodiment cable shackle assembly 704 and adds considerably more stress at the heel 708 end of the second embodiment shackle assembly 704 than the amount impacting a first embodiment shackle 204 heel 108.

Within the second embodiment shackle 704, the spiral extraction channel 652 is part of the heel end 708. When a second embodiment cable shackle 704 is installed in a lock body 100 or any other appropriate lock body, the heel end 708 of the second embodiment cable shackle 704 is inserted into the heel tube 608 until it contacts the shackle lock pin 732. Once contact between shackle lock pin 732 and the end of the shackle heel 708 occurs, the shackle heel 708 (when rotated) will drop downward as the shackle pin slot 640 coincides with the shackle lock pin 732. The shackle pin slot 640 then allows the shackle heel 708 to be rotated without impediment.

There is another significant difference between a rigid first embodiment shackle 204 and a flexible second embodiment cable shackle 704. The heel end 708 of a second embodiment cable shackle 704 can be twisted and rotated while the toe 712 end is locked into the lock body 100. Conversely, the rigid first embodiment heel 108 cannot be rotated when the toe 112 is locked to the lock body 100. One possible solution is to wind the heel 708 end of the second embodiment cable shackle 704 and ensure that at least seven hundred and twenty (720) degrees of rotation is required to extract the heel 708 end of a second embodiment shackle 704 from a lock body 100 while it is locked. If a thin pliable second embodiment shackle cable 716 is used as a part of a second embodiment shackle 704, it may be necessary to extend the necessary rotation required to extract the heel 708 from the lock body 100 by lengthening the spiral extraction channel 652. It will be extremely difficult if not impossible to rotate the heel end of a cable second embodiment shackle 708 two (2) complete revolutions while the toe end is rigidly anchored. Any thin or flimsy second embodiment shackle 704 that could be kinked to allow two revolutions would not be secure enough to warrant its use unless it is intended to be used in an environment that requires deterrence rather than authentic secure protection.

Figures 8A, 8B:
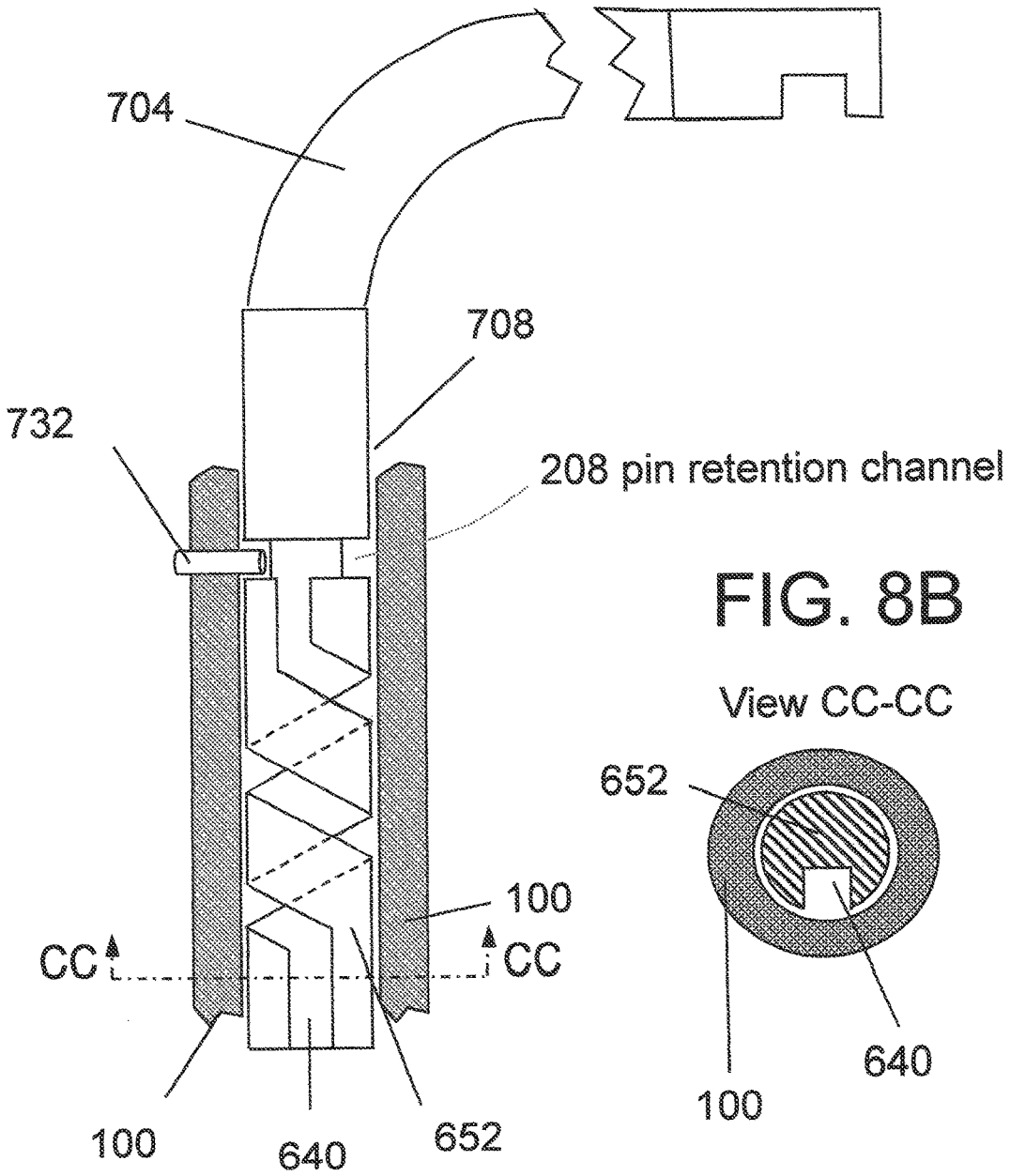
FIG. 8A a plan drawing of a second embodiment shackle.
FIG. 8B is a cross-sectional view of the lock of FIG. 8A, taken along the line CC-CC.

FIG. 8A depicts the heel end 708 of a second embodiment cable shackle 704. The heel end 708 of the second embodiment cable shackle is not required to move vertically when the second embodiment cable shackle 704 is unlocked. There may or may not be a requirement for the heel end 708 to rotate when the second embodiment cable shackle 704 is unlocked. FIG. 8A does show an example of the heel end of the second embodiment shackle 704 with a pin retention channel 208 which allows three hundred sixty (360) degree rotation.

Generally, it is recommended to not include a pin retention channel for the second embodiment shackle 704, as this can be used to help rotate the shackle cable 716 while the second embodiment shackle 704 is still locked, therefor increasing the chance of an unwanted breaching of the lock body. Instead, the spiral extraction channel 652 is used to insert the heel end 708 into and out of the lock body 100 using the shackle lock pin 732 as a fixed guide. The shackle lock pin 732 fits into the shackle pin lock slot 640 and is guided along the spiral extraction channel 652 when the shackle 704 is turned in a counter clockwise direction with a small amount of downward pressure. The heel end 708 will continue downward toward the bottom of the lock body until such time as the downward progress is ended due to interference between the shackle lock pin 732 and the top surface of the pin retention channel 208.

FIG. 8B is a cross-sectional view of the lock of FIG. 8A, taken along the line CC-CC.

Figure 9A:
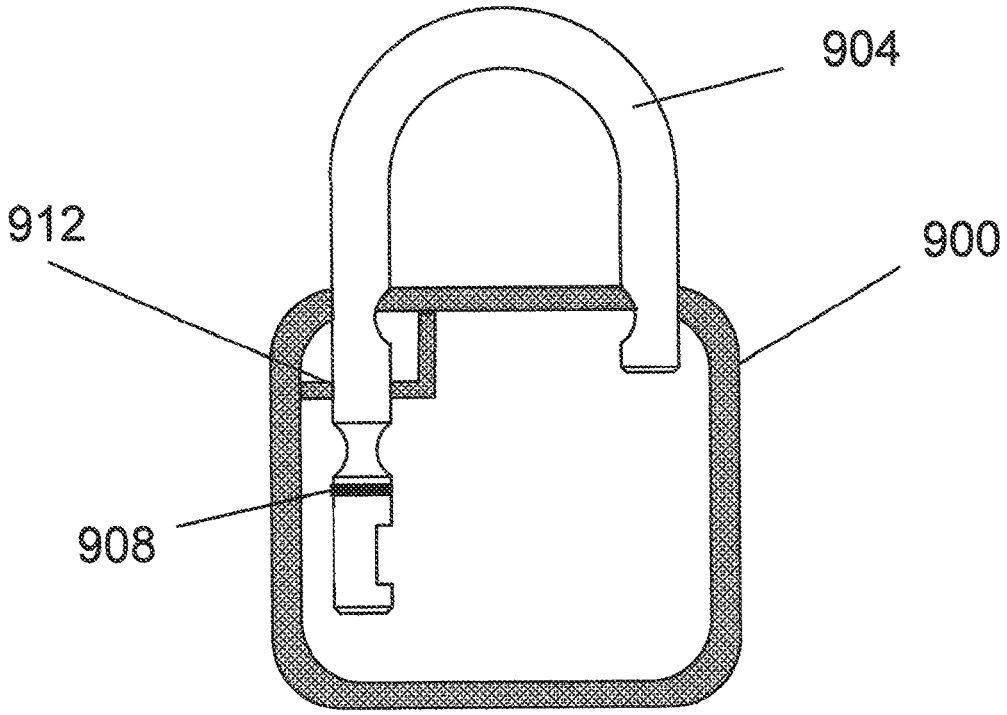
FIG. 9A is a cutaway view of a prior art portable lock.

FIG. 9A illustrates another common variant of portable lock which can benefit from another exemplary embodiment disclosed herein. Many types and designs of portable locks exist that are ineligible to incorporate the embodiments disclosed herein because they are small and lack sufficient lower shackle length that can be altered to integrate any of the preceding embodiments. Yet the potential improvements and advantages for these small locks can be just as beneficial as the improvements realized in the larger, longer-shackle portable locks (e.g. padlocks).

To address this, a third embodiment 904-1 is disclosed herein to fulfill the need to offer the capability to replace or alter shackles for these smaller lock products. The lock depicted in FIG. 9A does not offer a replaceable shackle. If the shackle of this lock or some of the many similar products is ever cut off, the lock must be entirely scrapped as it is not repairable. Still, even locks of this size offer technology functions including biometric recognition, BlueTooth®, RFID, and WI-FI operability and more enhancements which still drives retail pricing to $100 or more which is a significant influence for the product lifespan enhancing capabilities disclosed herein, such as not having to discard cut off locks. In addition to using the benefits of this third embodiment shackle 904 to extend the useful life of a small portable lock product, the ability to change shackle sizes and types are as beneficial in this product set as all of the ones previously discussed.

For convenient reference, the third embodiment will be divided into three sub-embodiments, which will be labeled shackle 904-1, shackle 916-2, and shackle 916-3. The shackle 904-1 is shown with FIG. 9A, the shackle 916-2 is shown within FIG. 9B, and shackle 916-3 is shown within FIGS. 9C-9D.

When locks of this sort without the capability to remove shackles are assembled, the shackle 904-1 is inserted and then a small C-clip or similar retainer 908 is inserted into a groove cut into the third embodiment shackle 904. If an attempt is made to extract the shackle 904, the C-clip or similar retainer 908 will prevent passage of the shackle 904-1 so that it is unable to pass thru the shackle mounting bracket 912. The fact that the lock is not repairable for such a simple problem becomes more problematic as many small locks of this sort utilize technology including but not limited to BlueTooth® and biometric fingerprint scanning. Small locks in this category can sell for e.g. $75 to $200. The cost advantages of making these locks repairable for shackle issues should make a good business case for this third embodiment, and potentially, for the first two embodiments also.

Figure 9B:
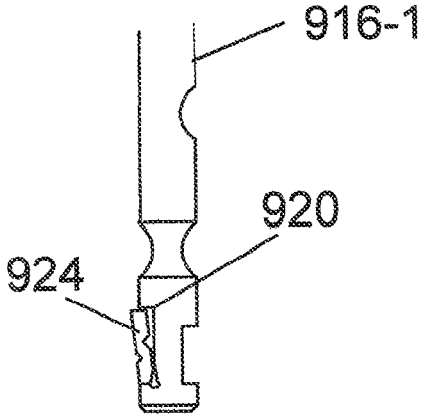
FIG. 9B is a front view of yet another exemplary third embodiment.

To solve these and other problems, FIG. 9B presents a variant of the third embodiment that will allow replacement of this shackle size made of plastic, nylon, polymer, and shackles made of other molded or 3D-printed materials. The molded third embodiment 916-2 has a breakaway indentation 920 and a breakaway protrusion 924. The breakaway protrusion 924 would serve the same purpose as the C-clip 908, and would limit the amount in the upward motion of the shackle 916-1 in the same manner that the C-clip 908 did for the original shackle 904. When the shackle 916-2 has been cut off or it is desired to replace the existing shackle with one of a different size, this can be done by exerting more upward force to cause the breakaway protrusion 924 to fold away from the breakaway indentation 920.

Strategically placed cuts and valleys in the breakaway protrusion 924 cause the protrusion 924 to fold, then break away, leaving the path open for extracting the new shackle 916-2. A new shackle 916-2 can then be inserted and the breakaway protrusion will be squeezed toward the breakaway indentation 920 until the end of the breakaway protrusion 924 clears the opening in the shackle bracket 912. Once clear of the shackle bracket 912, the breakaway protrusion 924 would then be capable of performing the C-clip function discussed earlier.

Replaceable metal shackles of the style depicted by FIG. 9B could be produced by cutting in the same size breakaway indentation 920 in a steel shackle and using adhesive to attach a breakaway protrusion 924 made from an appropriate plastic to exhibit the same characteristics exhibited by the breakaway protrusion 924 used in the plastic version of the shackle.

Figures 9C, 9D:
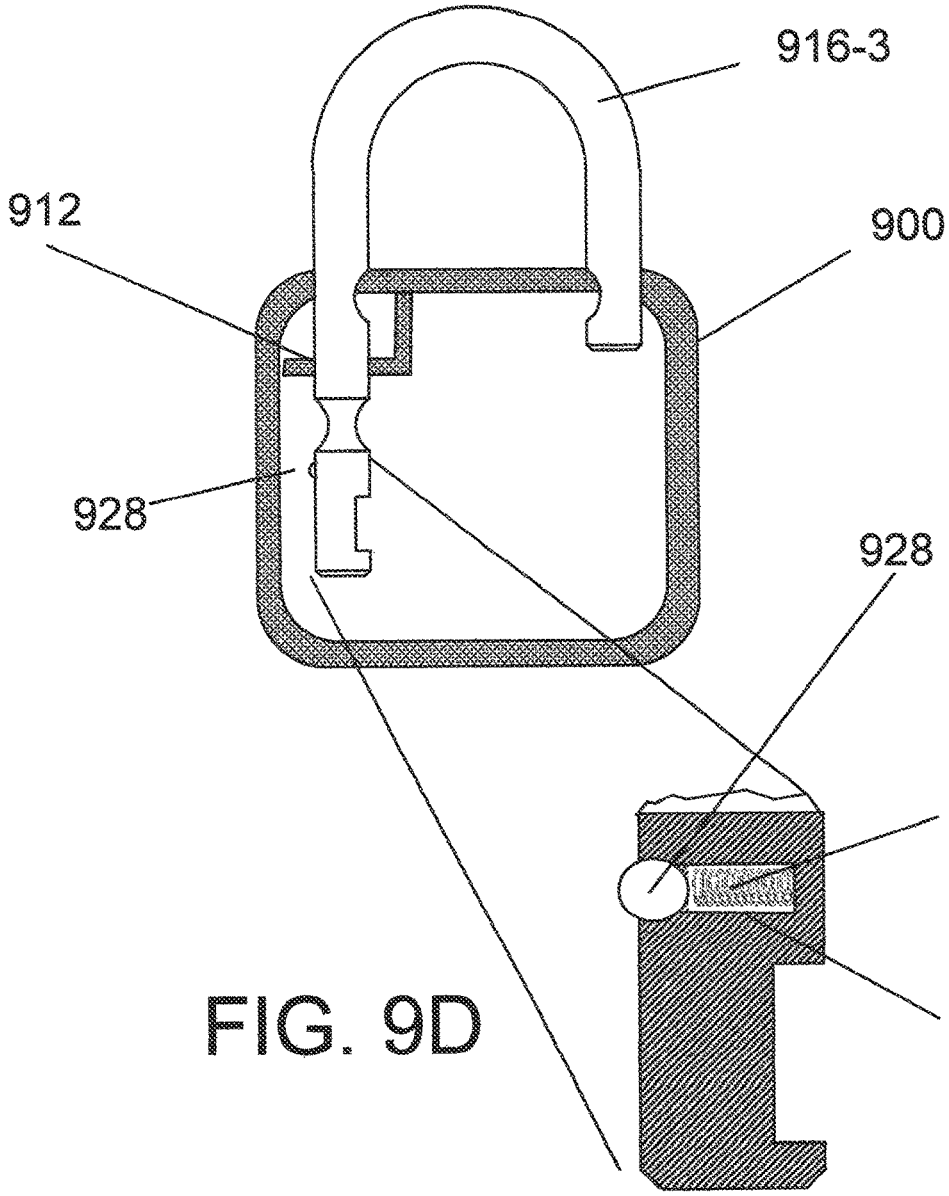
FIG. 9C is a front view of another third embodiment.
FIG. 9D is a top view of the embodiment of FIG. 9C.

FIG. 9C depicts another method to implement the third embodiment. A shackle check ball 926 can be embedded within a variant of the third embodiment shackle 916-3. A compression spring 932 shown in FIG. 9D is used to force the detent check ball 926 against the inner surface of the check ball opening.

When the shackle 916-3 is unlatched, it may be pulled out of the lock body 900 until such time as the 916-3 shackle check ball 928 encounters the shackle check ball orifice 912. The check ball orifice 912 is of a diameter that will permit unimpeded passage to the diameter of shackle 916-3. However, it will not permit passage of the additional cross section offered by the protruding portion of the shackle check ball 928, due to the smaller cross sectional area of the orifice 912. When the lock is unlocked, the entire third embodiment shackle 916-3 can be easily extracted up to the point whereas the additive cross section of the shackle 916-3 and the protruded portion of the check ball encounters the check ball orifice 912. Further extraction will require an overt amount of additional force to bring about compression of the compression spring 932 which allows the check ball 928 to retract into check ball passage 936 reducing the shackle cross section to a size that can pass thru the check ball orifice 912.

Figure 10:
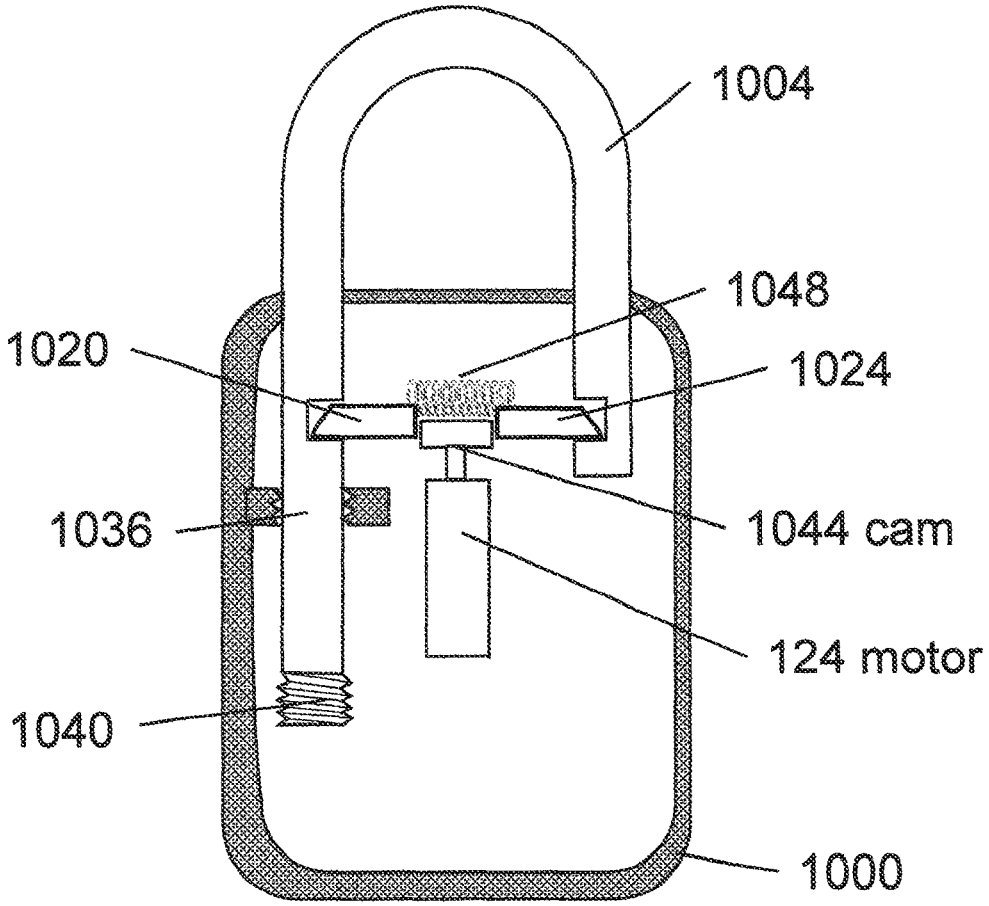
FIG. 10 is a front view of a fourth embodiment.

FIG. 10 describes yet another exemplary embodiment for replaceable shackles. The embodiments described heretofore are applicable to portable locks that latch the toe side of the shackle. However, there are many types of portable locks (e.g. padlocks) that latch both the toe side and the heel side of a shackle. Such is the case with the fourth embodiment lock consisting of a lock body 1000 with a threaded shackle lock-in opening 1036, a two notched shackle 1004 with a threaded heel lock in extension 1040, a shackle heel interposer 1020 and a shackle toe interposer 1024 which are operated by an electric motor 124 turning a interlock actuator cam 1044 with a cam follower spring 1048.

When the lock is open or the shackle 1004 is cut, the-two notched shackle 1004 may be removed by lifting the shackle 1004 until such time as the threaded heel extension 1040 encounters the threaded shackle lock-in opening. After the aforementioned contact, the shackle 1004 can be rotated in the direction defined by the threads on the shackle lock-in opening 1036 and the and the threaded heel lock in extension 1040 until the threaded heel lock in extension 1040 exits the shackle lock in opening 1036.

Interior space within the body of a portable lock is always very constrained, but especially with locks offering any technology enhancements such as biometric recognition, electronic interfaces such as BlueTooth®, control buttons, etc. and that batteries that power them. As such, this fourth embodiment uses up more interior space because there are two lock interposer shackles and additional mechanical linkage to operate them.

Figure 11A:
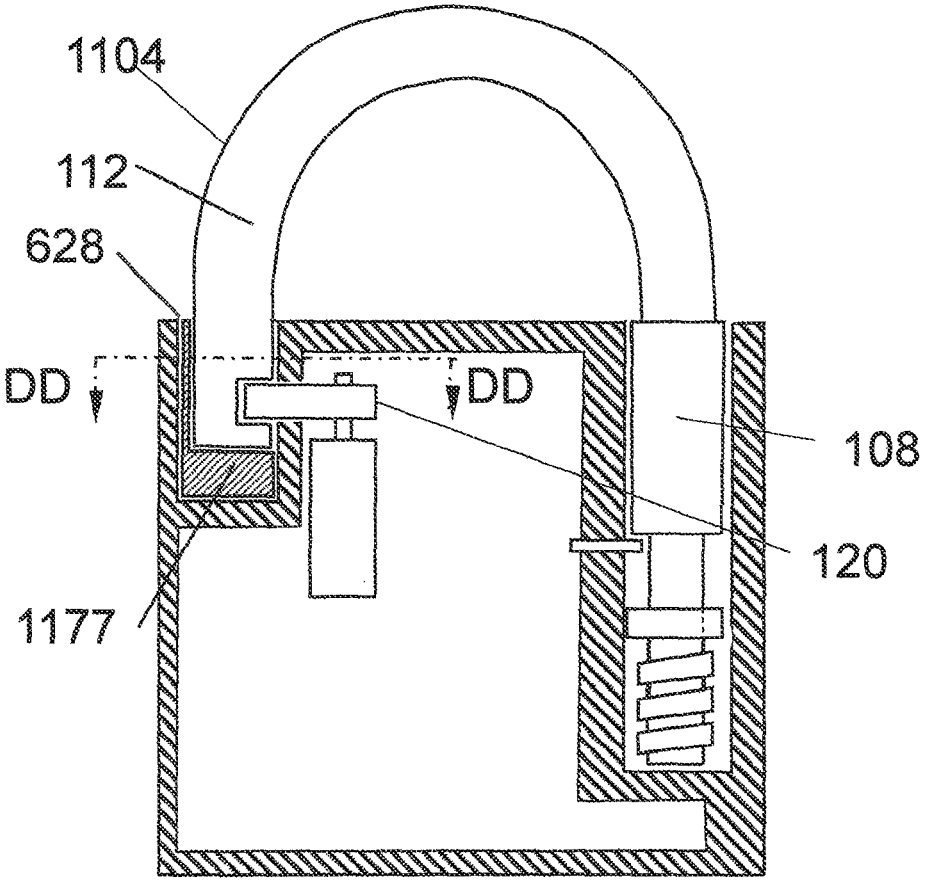
FIG. 11A is a side view of a fifth embodiment.
Figure 11B:
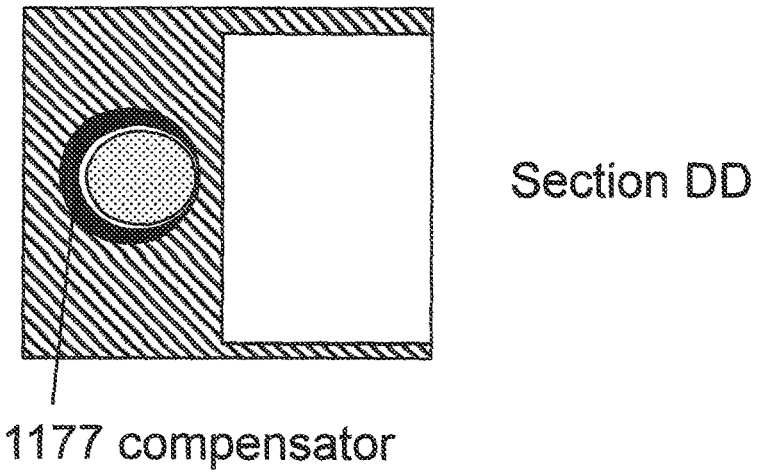
FIG. 11B is a cross-sectional view of the embodiment of FIG. 11A, taken along the line DD-DD.

FIG. 11A is a cutaway view of a lock body used to describe a feature that is applicable to all replaceable lock shackle embodiments and variants contained within this disclosure. When a portable lock is designed one of the most important initial specifications is the shackle diameter. Many common applications such as Pelican boxes, gym lockers, gun cases, LockOut/TagOut locks and others tend to use a shackle diameter of one quarter-inch, while many other applications especially where there exists higher security and safety considerations offer larger diameter shackles to provide better cut-off resistance and increased mechanical strength. Whatever the original shackle diameter is, introducing a shackle with a smaller diameter reduces the safety and security provided by the lock. On the other side, it is obvious that a portable lock with a shackle diameter that exceeds the openings in a lock hasp is unusable.

Many solutions are represented herein that can allow shackle substitution as a remedy for a shackle of the wrong shape, wrong opening size, wrong material, and/or the wrong design, such as rigid instead of flexible. One major parameter that is dictated by the lock body is shackle diameter. The design of a lock body is highly related to the diameter of the shackle that is mated with it.

To address this issue, FIG. 11A shows a fifth embodiment solution that will allow a lock body to perform well with a shackle that was designed and manufactured to work with a larger diameter shackle. The dual diameter shackle 1104 is so named because the diameter of the heel is the diameter the lock body 100 was originally designed and manufactured to use. The diameter of the remainder of the dual diameter shackle 1104 is the new smaller diameter desired to enable the lock body 100 to provide the appearance, shackle-to-lock-body-fit, and performance of a smaller diameter shackle. As a point of reference, the dual-diameter shackle 1104 is modified from the first embodiment shackle 204-3 shown in FIG. 6A. As stated previously, this disclosure concerns replaceable shackles only, and this fifth embodiment is only practical if replacing an existing shackle is needed.

It is vital that the toe end 112 of the dual diameter shackle 1104 fits into the shackle toe tube 628 such that the reduced diameter toe 112 opposes the shackle interlock 120 at the same distance and angle that that would be experienced by a shackle toe 112 with the same diameter originally intended for use with the lock body 100. The same shackle toe 112 and shackle interlock relativity is necessary to ensure that the lock offers the same degree of safety and security and the shackle interlock 120 engages and disengages smoothly with the toe 112.

In order to keep the distance between the notched side of the dual diameter shackle 1104 and the side of the shackle toe tube 628 that the shackle toe interposer slides thru consistent between the regular shackle and the dual diameter shackle 1104, the dual diameter shackle is offset so the dual diameter shackle toe 112 does not center within the shackle toe tube 628. The additional space between the toe tube 628 and the dual diameter shackle 1104 shown in FIG. 11C is filled by the insertion of the shackle size compensator 1177 into the toe tube 628.

Figure 11C:
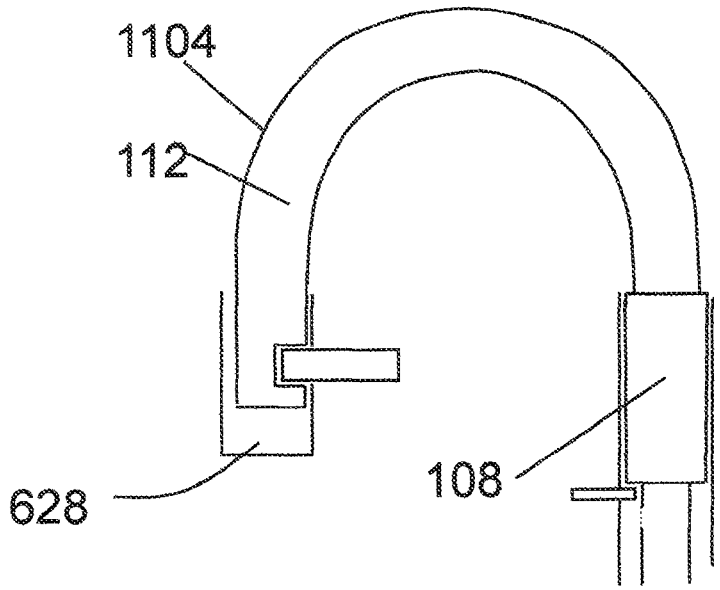
FIG. 11C is a view of the embodiment of FIG. 11A.
Figure 11D:
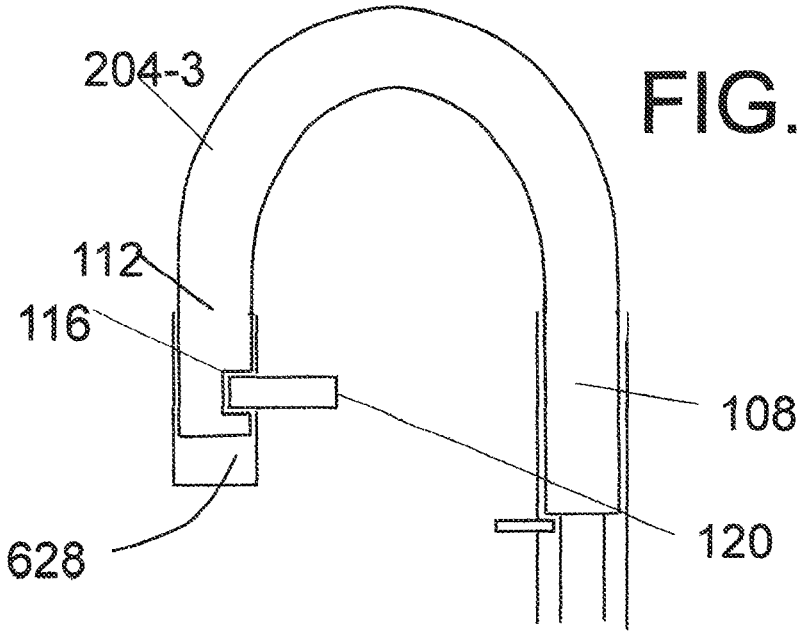
FIG. 11D is a view of the embodiment of FIG. 11A.

FIG. 11C and FIG. 11D demonstrate the difference between the way an ordinary first embodiment shackle 204-3 fits into the lock body 100 used to explain this embodiment and the way the fifth embodiment dual diameter shackle 1104 fits into the same lock body 100. Note the size of the gap between the left side of the shackle toe tube 628 and the left side of the dual diameter shackle 1104 shown in FIG. 11C and the gap between the left side of the first embodiment shackle 204-3 in FIG. 11D.

Figure 12A:
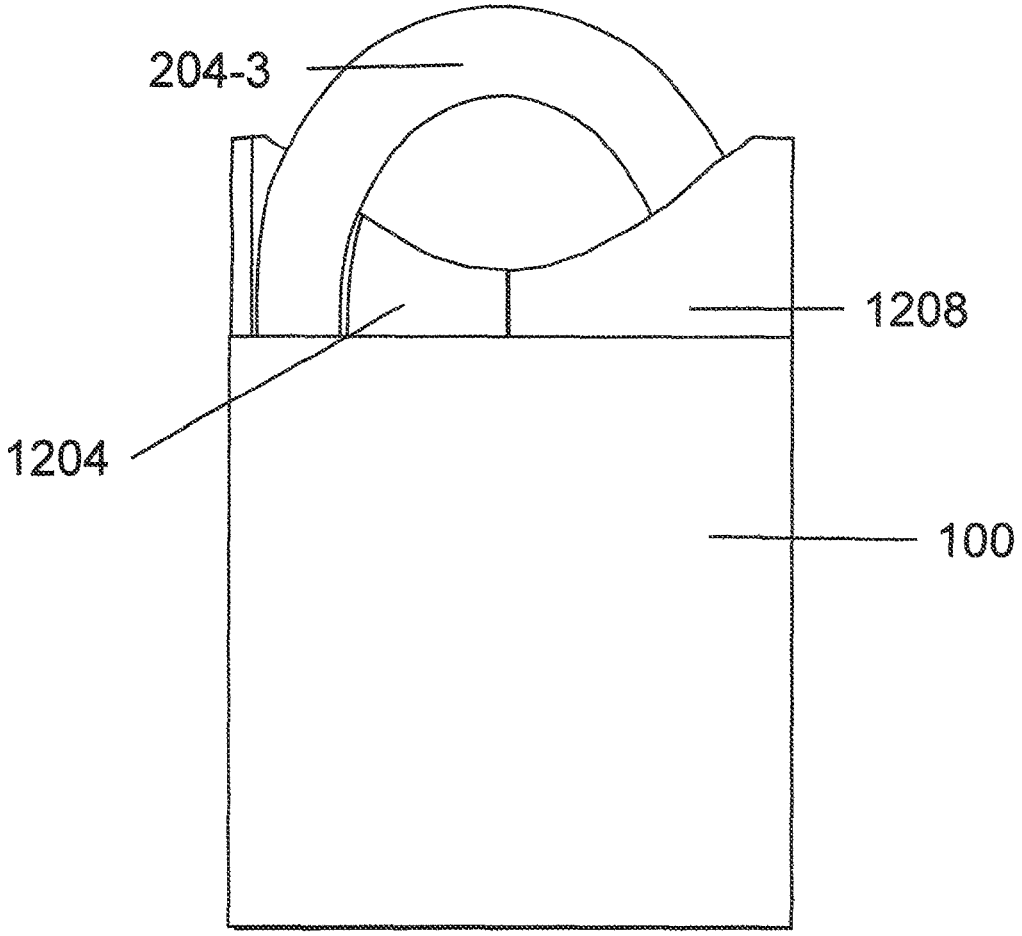
FIG. 12A is a view of a sixth embodiment.

FIG. 12A illustrates yet another safety and security improvement for portable locks that can be gained by any embodiments described by this disclosure. Lock shackle guards are a recognized method to enhance the safety and security of a portable lock.

Many portable locks are manufactured and sold with shackle guards. typical shackle guards are implemented by adding more steel or other metals used in the lock body to extend the top of the lock body. This is accomplished by enlarging the lock body molds for casted portable lock bodies or adding additional fabricated content upon a fabricated lock body 100.

The embodiments discussed herein are different. FIG. 12A shows the shackle heel shackle guard 1208 and the shackle toe shackle guard 1204, which are shown being used with the same first embodiment lock body 100 and the first embodiment shackle 204-3 explained previously.

The heel shackle guard 1208 is installed by removing the installed lock shackle which for the sake of this description will be the first embodiment shackle 203-4. It should be noted that any of the other solid shackle embodiments described herein could be used with a properly dimensioned set of shackle guards 1204 and 1208. The shackle guards could be used with a flexible cable shackle, however, the value added by doing so is low as there is much remaining exposed cable that cannot be protected in this fashion.

Following the removal of e.g. the installed first embodiment shackle 204-3, the shackle heel 108 can be inserted through the heel shackle guard 108 access opening 1216. The shackle 204-3 can then be installed by performing the necessary steps lock the shackle ready for lock usage. The toe shackle guard 1204 is then positioned in place prior to the insertion of the toe 112 into the lock body toe opening 1212. When the toe is pushed to the locked position, the descending shackle 204-3 engages the pressure point 1220 of the toe shackle guard 1204 which pushes the toe shackle guard to the left where it abuts to the heel shackle guard 1208. The abutment of the two shackle guards 1204 and 1208 locks them in place where they will remain until the lock is unlocked.

Figure 12B:
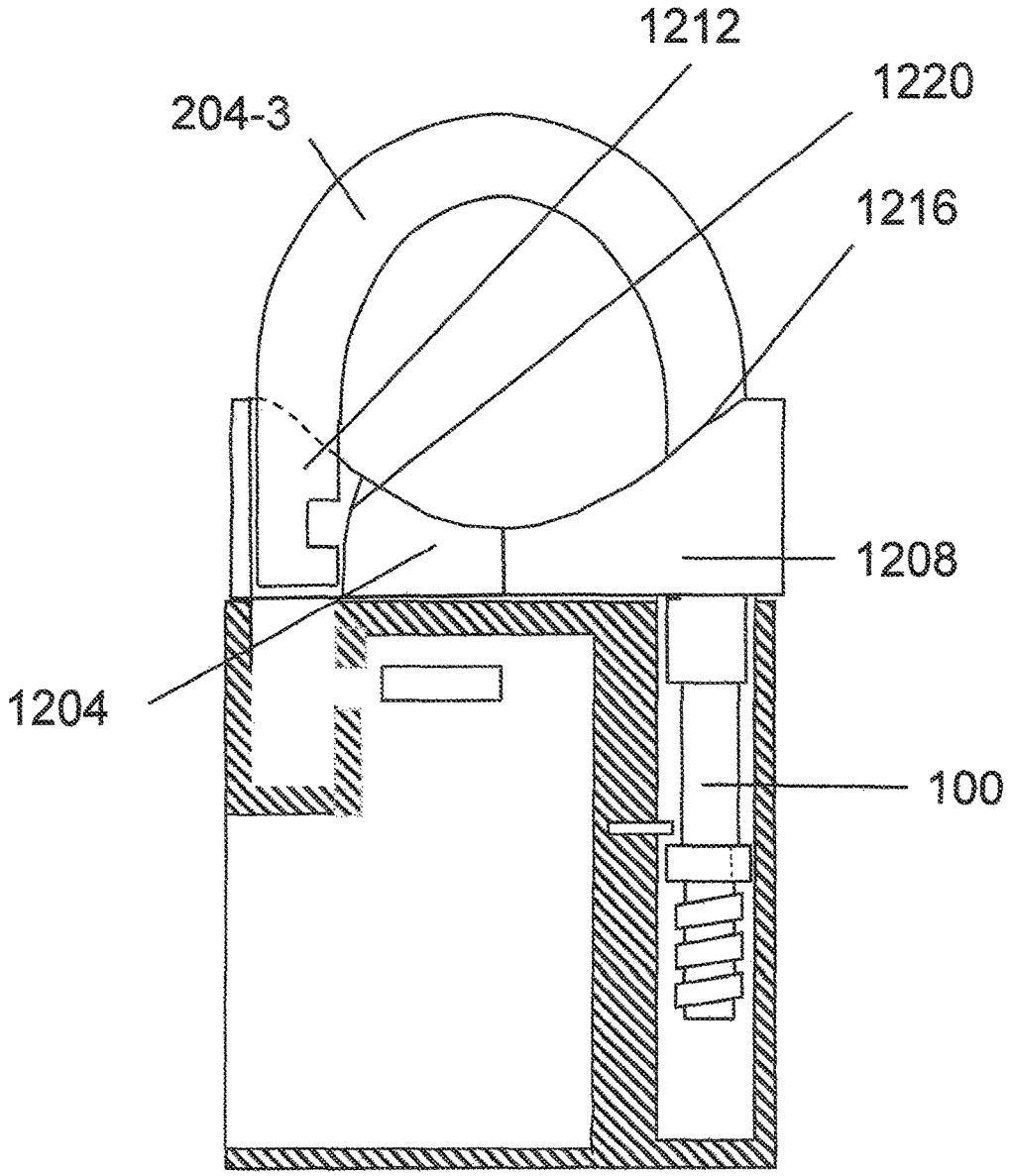
FIG. 12B is another view of the sixth embodiment.

An advantage of the removable shackle guards 1204/1208 shown in FIGS. 12A and 12B is that the same portable lock can be used as an ordinary portable lock, or can provide the added safety and security that a shackle guard can provide.

The use of a shackle guard can impede the capabilities of the portable lock as the shackle guards 1204 and 1208 may restrict the ability to fit larger objects within the restricted confines of the first embodiment shackle 204-3. When those circumstances arise, the shackle guards 1204 and 1208 can be quickly removed by removing and replacing the first embodiment shackle 204-3.

Figure 13:
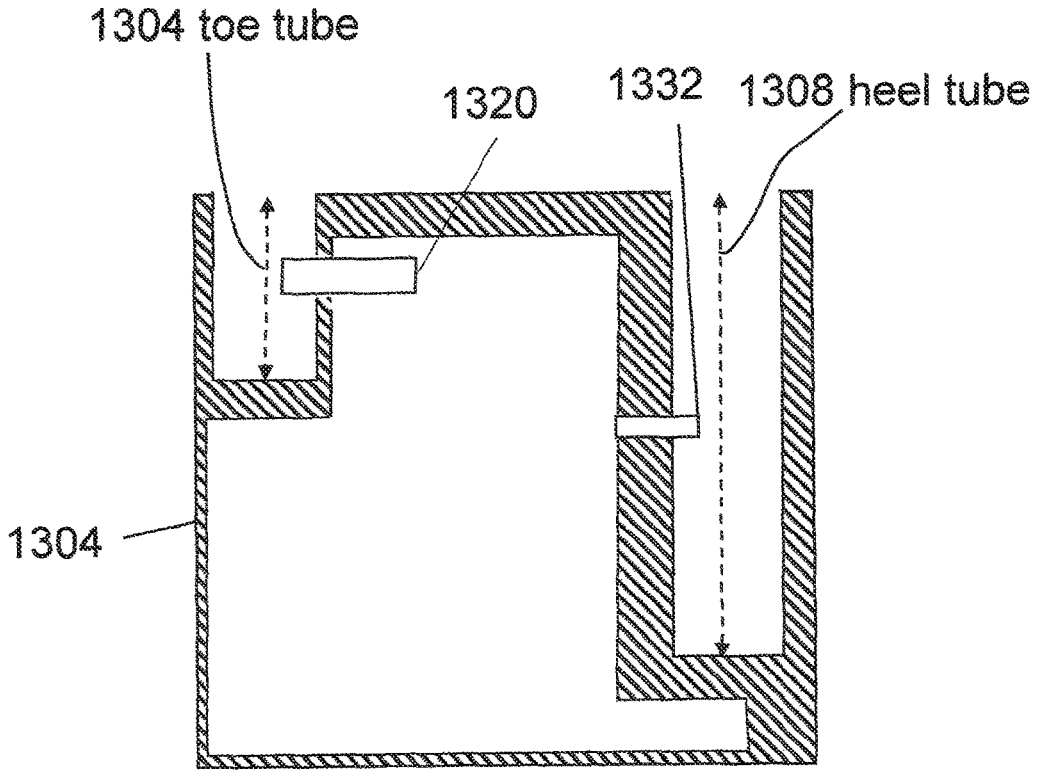
FIG. 13 is an explanatory view of various embodiments.

FIG. 13 shows a frontal cross sectional drawing of a representative portable lock body 1300 to be used as a guide to assist in defining a product set consisting of multiple lock body sizes and applications and a set of replaceable and switchable shackles offering a family of piece-part solutions. A primary objective of FIG. 13 is to demonstrate the capability and advantages of offering a piece-part set of inventory than can be matched and mated together to offer a customer the capability to quickly assemble unique portable locks and shackles.

All reference numbers will be uniquely re-numbered to FIG. 13 to consolidate the various concepts and solutions presented herein and provide a means of summarizing the various embodiments and variants.

When defining a common size of a lock body, the following elements must be consistent:

shackle heel tube 1308 diameter; and shackle toe tube 1304 diameter.

These would ordinarily be the same but there is no real requirement:

length of shackle lock pin 1332 penetration into the shackle heel tube 1308 diameter of shackle lock pin 1332;

shackle lock pin material;

method of shackle lock pin 1332 attachment;

distance the shackle lock pin is below the shackle heel tube 1308 top;

center to center distance from toe tube 1304 and heel tube 1308;

cross sectional measurements of the shackle interposer cam 1320;

distance from top of the shackle interposer cam 1320 to the top opening of the shackle toe tube 1308;

type of shackle attachment(s) utilized;

depth and width of any unthreaded channels;

diameter, pitch and length of any threaded fasteners or components;

materials used for construction (be aware of Galvanic corrosion); and any environmental exceptions required such as higher than usual temperature.

It should be pointed out that some of the variants described herein could be used as solutions for embodiments other than the one where they were featured. Some instances that would require duplicate documentation and FIGS of a variant under two embodiments were deliberately omitted for the sake of brevity and clarity. The embodiments of the invention in the abovementioned specification have been defined with reference to numerous details that are specific and may be different between applications and practice. Thus being the indicator of what is the invention, and its intent to be the invention, is the set of claims only that is issued from this application, in the specific form(s) including any corrections. Any definitions expressed herein for terminology contained in such claims shall administer the meaning of such terms as used in the claims. No attribute, benefit, element, feature, limitation, or property that is not particularly recited in a claim should limit the scope of such claim in any means. The specification and drawings are not restrictive as they are to be regarded as illustrative and defining purposes.

What is claimed is:

1. A replaceable shackle, comprising:

a tubular shank, having a toe and a heel portion;

the shank having one or more protruding cams located therein;

the heel being located in a first of two apertures within a lock body;

the toe being located in the second of the two apertures;

the lock body having an engagement pin;

the one or more cams each having an extraction channel machined therein that impedes upward movement and extraction of the shackle based upon the rotational position of the shackle relative to the lock body and engagement pin.

2. The replaceable shackle of claim 1, further comprising:

the tubular shank being rigid and having a pin retention channel, wherein the pin retention channel permits the shank to be rotatable 360 degrees; and the engagement pin having a predetermined shape suitable for passing through the one or more extraction channels.

3. The replaceable shackle of claim 1, further comprising:

the tubular shank being rigid and having a pin retention channel, wherein the pin retention channel permits the shank to be rotatable 180 degrees; and the engagement pin having a predetermined shape suitable for passing through the one or more extraction channels.

4. The replaceable shackle of claim 3, further comprising:

the heel having a pin retention slot.

5. The replaceable shackle of claim 4, wherein:

the heel having a pin retention channel.

6. The replaceable shackle of claim 1, further comprising:

the tubular shank being rigid and requiring a spiral rotation in order to match the engagement pin with the one or more extraction channels.

7. The replaceable shackle of claim 6, further comprising:

a heel tube limiter; wherein upward motion of the shackle is impeded by the top of the heel tube limiter striking the shackle lock pin.

8. The replaceable shackle of claim 6, further comprising:

a toe tube, having an opening; wherein the shackle can be rotated 360 degrees only when the toe is clear of the opening within the toe tube.

9. A replaceable shackle, comprising:

a tubular shank, having a toe and a heel portion, and having two or more diameters;

the shank having one or more protruding cams located therein;

the heel being located in a first of two apertures within a lock body;

the toe being located in the second of the two apertures;

the lock body having an engagement pin;

the one or more cams each having an extraction channel machined therein that impedes upward movement and extraction of the shackle based upon the rotational position of the shackle relative to the lock body and engagement pin;

a toe tube;

a shackle toe interposer;

wherein the shackle toe tube slides through the toe interposer consistent between the regular shackle and the dual diameter shackle.

10. The replaceable shackle of claim 9, further comprising:

the dual diameter shank being offset so the toe does not center within the shackle toe tube.

11. The replaceable shackle of claim 10, further comprising:

a shackle size compensator; wherein the additional space between the toe tube and the dual diameter shank is filled by insertion of the shackle size compensator into the toe tube.

12. The replaceable shackle of claim 1, wherein the shackle can be removed from the lock body with no disassembly or removal of parts.

13. The replaceable shackle of claim 1, wherein the shackle can be removed from the lock body by hand and where no tools are needed.

14. The replaceable shackle of claim 9, wherein the shackle can be removed from the lock body with no disassembly or removal of parts.

15. The replaceable shackle of claim 9, wherein the shackle can be removed from the lock body by hand and where no tools are needed.

16. The replaceable shackle of claim 1, wherein while the lock is in an open position, the shackle can be removed from the lock body without needing a key, combination, code, or biometric information.

* * * * *